US010582327B2

(12) United States Patent
Gerrard et al.

(10) Patent No.: US 10,582,327 B2
(45) Date of Patent: Mar. 3, 2020

(54) SYSTEMS AND METHODS FOR PROVIDING AN IMMERSIVE LISTENING EXPERIENCE IN A LIMITED AREA USING A REAR SOUND BAR

(71) Applicant: DOLBY LABORATORIES LICENSING CORPORATION, San Francisco, CA (US)

(72) Inventors: Mark William Gerrard, Balmain (AU); Michael William Mason, Wahroonga (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 16/158,064

(22) Filed: Oct. 11, 2018

(65) Prior Publication Data

US 2019/0116445 A1 Apr. 18, 2019

Related U.S. Application Data

(60) Provisional application No. 62/572,103, filed on Oct. 13, 2017.

(51) Int. Cl.

| | |
|---|---|
| ***H04S 7/00*** | (2006.01) |
| ***H04S 5/02*** | (2006.01) |
| ***H04R 5/02*** | (2006.01) |
| *H04S 3/00* | (2006.01) |

(52) U.S. Cl.

CPC ..... *H04S 7/303* (2013.01); *H04R 5/02* (2013.01); *H04S 7/302* (2013.01); *H04S 3/008* (2013.01); *H04S 2400/01* (2013.01); *H04S 2400/07* (2013.01); *H04S 2400/13* (2013.01); *H04S 2420/01* (2013.01)

(58) Field of Classification Search

CPC ..... H04S 7/302; H04S 5/02; H04S 2400/01; H04S 2400/13; H04S 3/008; H04S 7/303

See application file for complete search history.

(56) References Cited

U.S. PATENT DOCUMENTS

| | | | | |
|---|---|---|---|---|
| 6,577,736 | B1 | 6/2003 | Clemow | |
| 2009/0136048 | A1 | 5/2009 | Yoo | |
| 2011/0243338 | A1* | 10/2011 | Brown | H04S 3/002 381/17 |
| 2012/0070021 | A1 | 3/2012 | Yoo | |

(Continued)

FOREIGN PATENT DOCUMENTS

| | | |
|---|---|---|
| EP | 1769491 | 4/2007 |
| WO | 2008/135049 | 11/2008 |

OTHER PUBLICATIONS

Can I daisy chain multiple sound bars together to create a surround sound from all angles in the room? http://www.tomsguide.com/answers/id-2965440/daisy-chain-multiple-sound-bars-create-surround-sound-angles-room.html.

*Primary Examiner* — Regina N Holder

(57) ABSTRACT

Systems and methods are described for providing an immersive listening area for one or more listeners. To improve the immersive experience a rear sound bar is placed behind the listeners and the input channels of the rear sound bar receive customized processing to create a virtual rear sound stage. The virtual rear sound stage and a front sound stage created by a front sound bar, combine to create an overall sound stage to encompass the listeners, providing the listeners with an immersive listening experience.

21 Claims, 16 Drawing Sheets

(56) References Cited

U.S. PATENT DOCUMENTS

| | | | | |
|---|---|---|---|---|
| 2013/0301861 | A1 | 11/2013 | Ho | |
| 2015/0055807 | A1 | 2/2015 | Stepputat | |
| 2015/0223002 | A1 | 8/2015 | Mehta | |
| 2015/0350804 | A1 | 12/2015 | Crockett | |
| 2016/0112819 | A1 | 4/2016 | Mehnert | |
| 2017/0325043 | A1* | 11/2017 | Jot ..... | H04S 7/302 |
| 2018/0262858 | A1* | 9/2018 | Noh ..... | H04S 7/304 |

* cited by examiner

Each listener is outside of the immersive area because the speakers cannot create a rear soundstage Large immersive listening area because the relative distances to the surround speakers are similar for each listener and speakers are behind the listeners

SYSTEMS AND METHODS FOR PROVIDING AN IMMERSIVE LISTENING EXPERIENCE IN A LIMITED AREA USING A REAR SOUND BAR

CROSS REFERENCE TO RELATED APPLICATIONS

This application claims priority to U.S. Provisional Patent Application No. 62/572,103, filed on Oct. 13, 2017, the disclosure of which is incorporated herein by reference in its entirety.

TECHNICAL FIELD

Embodiments herein relate generally to sound reproduction systems and methods and more specifically to providing an immersive listening area for a plurality of listeners using a rear sound bar.

SUMMARY OF THE INVENTION

Systems and methods are described for providing an immersive listening area. In an embodiment of a method for a providing an immersive listening area, a rear virtualizer receives a first set of rear audio signals. The rear virtualizer processes the first set of rear audio signals to create a second set of rear audio signals suitable for playback on a rear sound bar. This processing uses a first virtualization algorithm. In addition, a first set of front audio signals suitable for playback on a front set of speakers is created.

In an embodiment of the method, the first virtualization algorithm accounts for: a speaker configuration of the rear sound bar, an intended location of the rear sound bar being behind a listener, and an intended distance of the listener from the rear sound bar.

In an embodiment of the method, the intended location of the rear sound bar includes being adjacent to a rear wall, and the intended distance of the listener from the rear sound bar is within a pre-determined distance.

An embodiment of the method further includes: providing the second set of rear audio signals to the rear sound bar, and providing a first set of front audio signals to a front set of speakers, creating a rear sound stage by the rear sound bar upon playback of the second set of rear audio signals, and creating a front sound stage by the front set of speakers upon playback of the first set of front audio signals. In this embodiment, the front sound stage combines with the rear sound stage to create an overall sound stage.

In an embodiment of the method, processing, by the rear virtualizer, the first set of rear audio signals to create a second set of rear audio signals suitable for playback on a rear sound bar includes: decorrolating the received first set of rear audio signals to create a decorrolated set of rear audio signals based on a number of channels in the rear sound bar; gain-adjusting the decorrolated set of rear audio signals to create a gain-adjusted set of rear audio signals, and cross-mixing the gain-adjusted set of rear audio signals to create the second set of rear audio signals.

In an embodiment of the method, processing, by the rear virtualizer, the first set of rear audio signals to create a second set of rear audio signals suitable for playback on a rear sound bar includes: processing, by a rear height virtualizer, a subset of the received first set of rear audio signals; not processing, by the rear height virtualizer, the remainder of the received first set of rear audio signals. The embodiment then includes, using the first virtualization algorithm to: decorrolate the processed subset and the remainder of the received first set of rear audio signals to create a decorrolated set of rear audio signals based on a number of channels in the rear sound bar; gain-adjust the decorrolated set of rear audio signals to create a gain-adjusted set of rear audio signals; and cross-mix the gain-adjusted set of rear audio signals to create the second set of rear audio signals.

In an embodiment of the method, the front set of speakers is included within a front sound bar, and the first set of front audio signals are front audio signals suitable for playback on the front sound bar. In this embodiment, the first set of front audio signals are created by processing, by a front virtualizer, an initial set of front audio signals to create the first set of front audio signals. This processing uses a second virtualization algorithm that accounts for: a speaker configuration of the front sound bar, and an intended distance of the listener from the front sound bar.

In an embodiment of the method, the first virtualization algorithm employs at least one of: cross talk cancellation, binauralization, and diffuse panning.

According to another embodiment, an audio processing unit includes a memory and a processor, the memory including instructions which when executed by the processor perform a method for providing an immersive listening area. In this embodiment, the method comprises: receiving, by a rear virtualizer, a first set of rear audio signals; processing, by the rear virtualizer, the first set of rear audio signals to create a second set of rear audio signals suitable for playback on a rear sound bar, the processing using a first virtualization algorithm; and creating a first set of front audio signals suitable for playback on a front set of speakers.

In an embodiment of the audio processing unit, the first virtualization algorithm accounts for: a speaker configuration of the rear sound bar, an intended location of the rear sound bar being behind a listener, and an intended distance of the listener from the rear sound bar.

In an embodiment of the audio processing unit, the intended location of the rear sound bar includes being adjacent to a rear wall, and the intended distance of the listener from the rear sound bar is within a pre-determined distance.

In an embodiment of the audio processing unit, the audio processing unit further includes the rear sound bar and the method further comprises: providing, by the audio processing unit, the second set of rear audio signals to the rear sound bar.

In an embodiment of the audio processing unit, the processing, by the rear virtualizer component, the first set of rear audio signals to create a second set of rear audio signals suitable for playback on a rear sound bar includes: decorrolating the received first set of rear audio signals to create a decorrolated set of rear audio signals based on a number of channels in the rear sound bar; gain-adjusting the decorrolated set of rear audio signals to create a gain-adjusted set of rear audio signals, and cross-mixing the gain-adjusted set of rear audio signals to create the second set of rear audio signals.

In an embodiment of the audio processing unit, the processing, by the rear virtualizer component, the first set of rear audio signals to create a second set of rear audio signals suitable for playback on a rear sound bar includes: processing, by a rear height virtualizer, a subset of the received first set of rear audio signals; and not processing, by the rear height virtualizer, the remainder of the received first set of rear audio signals. The embodiment then includes, using the first virtualization algorithm to: decorrolate the processed subset and the remainder of the received first set of rear audio signals to create a decorrolated set of rear audio signals based on a number of channels in the rear sound bar; gain-adjust the decorrolated set of rear audio signals to create a gain-adjusted set of rear audio signals; and cross-mix the gain-adjusted set of rear audio signals to create the second set of rear audio signals.

In an embodiment, the method further comprises creating a first set of front audio signals for a front set of speakers.

In an embodiment, the front set of speakers includes a front sound bar, and the first set of front audio signals are front audio signals suitable for playback on the front sound bar. In this embodiment, the method further comprises processing, by a front virtualizer component, an initial set of front audio signals to create the first set of front audio signals, where the processing uses a second panning algorithm that accounts for: a speaker configuration of the front sound bar, and an intended distance of the listener from the front sound bar.

In an embodiment, the first virtualization algorithm uses at least one of: cross talk cancellation, binauralization, and diffuse panning.

In another embodiment, a system for a providing an immersive listening area comprises: a decoder configured to provide a front set and a rear set of signals; a front plurality of speakers configured to provide a front sound stage upon receiving the front set of signals; a rear virtualizer configured to receive the rear set of signals and to provide a set of virtualized rear signals; and a rear sound bar configured to receive the set of virtualized rear signals and provide a rear sound stage upon playback of the virtualized rear signals.

In an embodiment of the system, the first virtualization algorithm accounts for: a speaker configuration of the rear sound bar, an intended location of the rear sound bar being behind a listener, and an intended distance of the listener from the rear sound bar.

In an embodiment of the system, the intended location of the rear sound bar includes being adjacent to a rear wall, and the intended distance of the listener from the rear sound bar is within a pre-determined distance.

In an embodiment of the system, the rear virtualizer includes a height virtualizer, a decorrolator, and a gain-adjusted cross-mixer, and the height virtualizer is configured to receive the rear height signals and provide a set of virtualized height signals to the decorrolator, the decorrolator is configured to receive the rear surround signals and the virtualized height signals and provide a decorrolated set of signals to the gain-adjusted cross-mixer, and the gain-adjusted cross-mixer is configured to provide the set of virtualized rear signals to the rear sound bar.

In an embodiment of the system, the rear virtualizer includes a first decorrolator, a second decorrolator, and a gain-adjusted cross-mixer, and the first decorrolator is configured to receive a first rear signal and provide a first decorrolated set of signals to the gain-adjusted cross-mixer, the second decorrolator is configured to receive a second rear signal and provide a second set of decorrolated signals to the gain-adjusted cross-mixer, and the gain-adjusted cross-mixer is configured to provide the third set of signals using the first and second sets of decorrolated signals.

In an embodiment of the system, to provide a virtualized set of rear signals, the rear virtualizer uses at least one of: cross talk cancellation, binauralization, and diffuse panning.

BRIEF DESCRIPTION OF THE FIGURES

This disclosure is illustrated by way of example and not limitation in the figures of the accompanying drawings, in which like references indicate similar elements, and in which.

DETAILED DESCRIPTION

Discrete multichannel surround sound systems may provide a large immersive listening area (or "sweet spot") in which a listener may have an immersive listening experience because the speakers may be placed around the listeners' position. In other words, a spatially encompassing sound stage (an "immersive listening area") may be created using an unrestricted set of speakers. Regarding "unrestricted," the speaker set is "unrestricted" in the sense that the speakers may be located freely around the listener, including, for example, speakers in the listener plane (e.g. left/right surround speakers) or above and below the listeners (e.g. ceiling speakers). In contrast, a front sound stage is an example of a non-encompassing sound stage (a "non-immersive listening area") that may be created using a restricted set of speakers, where "restricted" means that the speakers are all located in front of the listener. Auditory scenes created using any of the sets of, e.g.: mono/front; left and right; left, right, and center; or a sound bar in front of the listener virtualizing such channels would be considered front sound stages.

Figure 1:
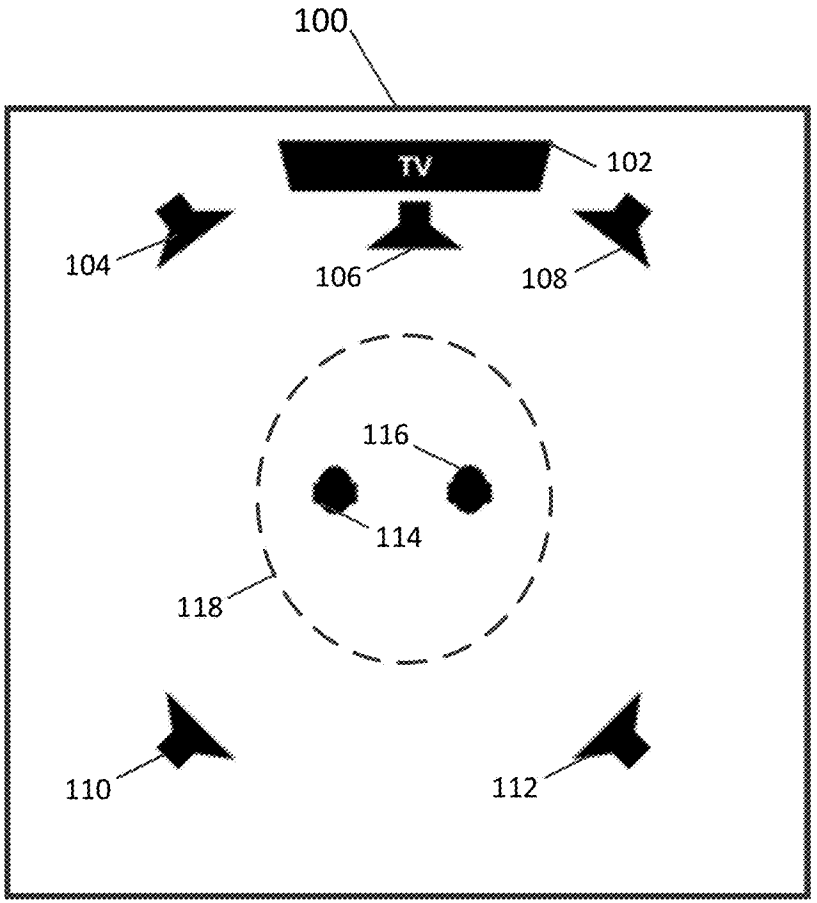
FIG. 1 illustrates a discrete speaker setup in a large home theater room.

See, for example, FIG. 1, which illustrates a discrete speaker setup in a large home theater room. In FIG. 1 a discrete speaker 5.0 surround sound setup in a large home theater room 100 includes a left speaker 104, a center speaker 106, a right speaker 108, a left surround speaker 110 and a right surround speaker 112. A TV screen 102 does not have a separate speaker in this setup. Home theater room 100 is large enough that the speakers may be placed around listeners 114, 116 and at similar distances from listeners 114, 116. In other words, room 100 allows for the unrestricted placement of the speakers. Thus, the surround sound setup produces an area providing an immersive experience 118 that may encompass both listeners 114, 116, providing each listener an immersive listening experience.

Figure 2:
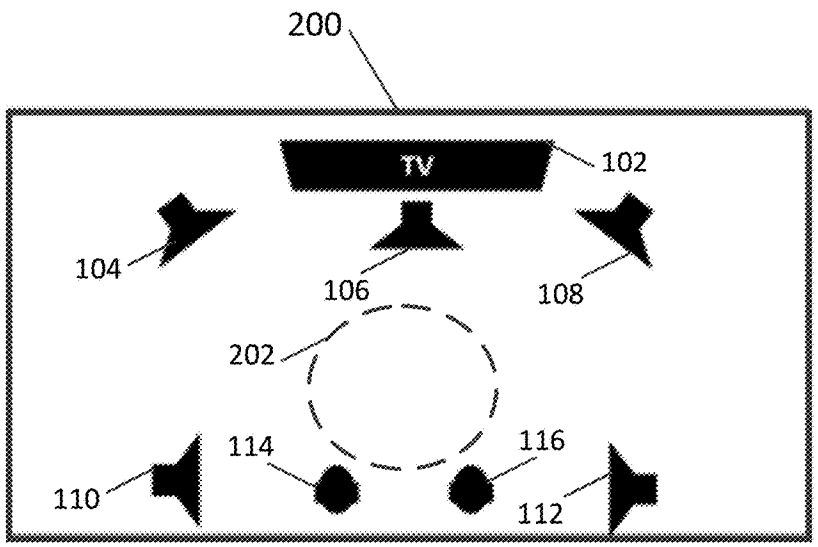
FIG. 2 illustrates a discrete speaker setup in a small home theater room.

In contrast, small living spaces typically require that at least some of the speakers of discrete multichannel surround sound setups be placed very close to the listener's position—the room does not allow the unrestricted placement of the speakers. This results in a very small area providing an immersive experience, or reduces or prevents the ability of the system to provide an immersive listening area at the listeners' location. See, for example, FIG. 2, which illustrates a discrete speaker setup in a small home theater room. In FIG. 2, the discrete speaker 5.0 surround sound setup of FIG. 1 is shown in a much smaller home theater room 200. Home theater room 200 is small enough that left surround speaker 110 and right surround speaker 112 must be positioned much closer to listeners 114, 116 than left, center, and right speakers 104, 106, 108. Furthermore, the size of room 200 does not allow speakers 110, 112 to be positioned behind listeners 114, 116 (at their current location), which eliminates the ability to create a rear sound stage to give listeners 114, 116 the impression that sound is coming from behind them. Thus, in home theater room 200 the surround sound setup produces an area providing an immersive listening experience 202 that does not encompass listeners 114, 116. Rather, as illustrated, each listener is outside of immersive listening area 202.

Furthermore listener 114 is much closer to speaker 110 than is listener 116. Similarly, listener 116 is much closer to speaker 112 than listener 114. Thus, each may have a significantly different listening experience—one which is very probably not ideal since neither listener is within immersive listening area 202. It should be noted that the relative sizes of immersive listening areas 118 (FIG. 1), 202 (FIG. 2), 310 (FIG. 3A), 312 (FIG. 3B), and 360 (FIG. 3C) are representative, to illustrate the issues associated with speaker placement in rooms of different sizes, rather than experimentally determined.

One known solution to surround sound in small home theatre space 200 is to use a sound bar at the front of the room, under TV screen 102, with post-processing to virtualize the presence of a complete home theatre installation with discrete speakers. These systems can be very effective at creating a wide and high soundstage for the listener. However, virtualization effects of such systems are insufficient to make a listener believe that sound is coming from behind the listener. The result of listening to content, which is intended to be immersive, using only a sound bar at the front of the room is that the rear auditory sound stage disappears, leaving only the front sound stage. The overall sound stage (i.e., the locations from which the sound may appear to originate) is thus limited to, at best, the 180 degrees in front of the listeners, and cannot completely envelope them. A current solution to this limitation is to pair a front sound bar with rear satellite speakers, e.g., speakers 110, 112 (FIG. 2). However, this solution is inadequate because it does not overcome the problem of having discrete speakers in a small listening environment—the sound stage is still limited to the 180 degrees in front of the listeners.

An object of the disclosed subject matter is to overcome these limitations by using a rear speaker array that receives virtualized speaker input signals (e.g., a sound bar that receives virtualized speaker input signals) to provide an immersive listening area. Thus, embodiments may provide an immersive listening experience to a plurality of listeners. To provide the immersive experience embodiments pair a rear sound bar, placed behind the listeners, with a front sound bar or discrete front speakers or both, placed at the front of the room. In an embodiment, the surround channels of the rear sound bar undergo customized processing to create a virtualized rear sound stage, which, when combined with the sound stage created by the front sound bar or discrete speakers or both, creates an overall sound stage large enough to encompass the listeners, providing each listener an immersive listening experience.

In an embodiment, an immersive listening area may be realized in a small home theater room using a rear sound bar with relatively small drivers, making the sound bar small and narrow enough to fit, for example, behind a chair in the room. Advantages of using such a form factor include that the sound bar occupies less space than discrete satellite speakers and that the rear sound bar provides a rear sound stage representation—one that, when combined with a front sound stage, may provide listeners with an immersive listening experience.

Figure 3A:
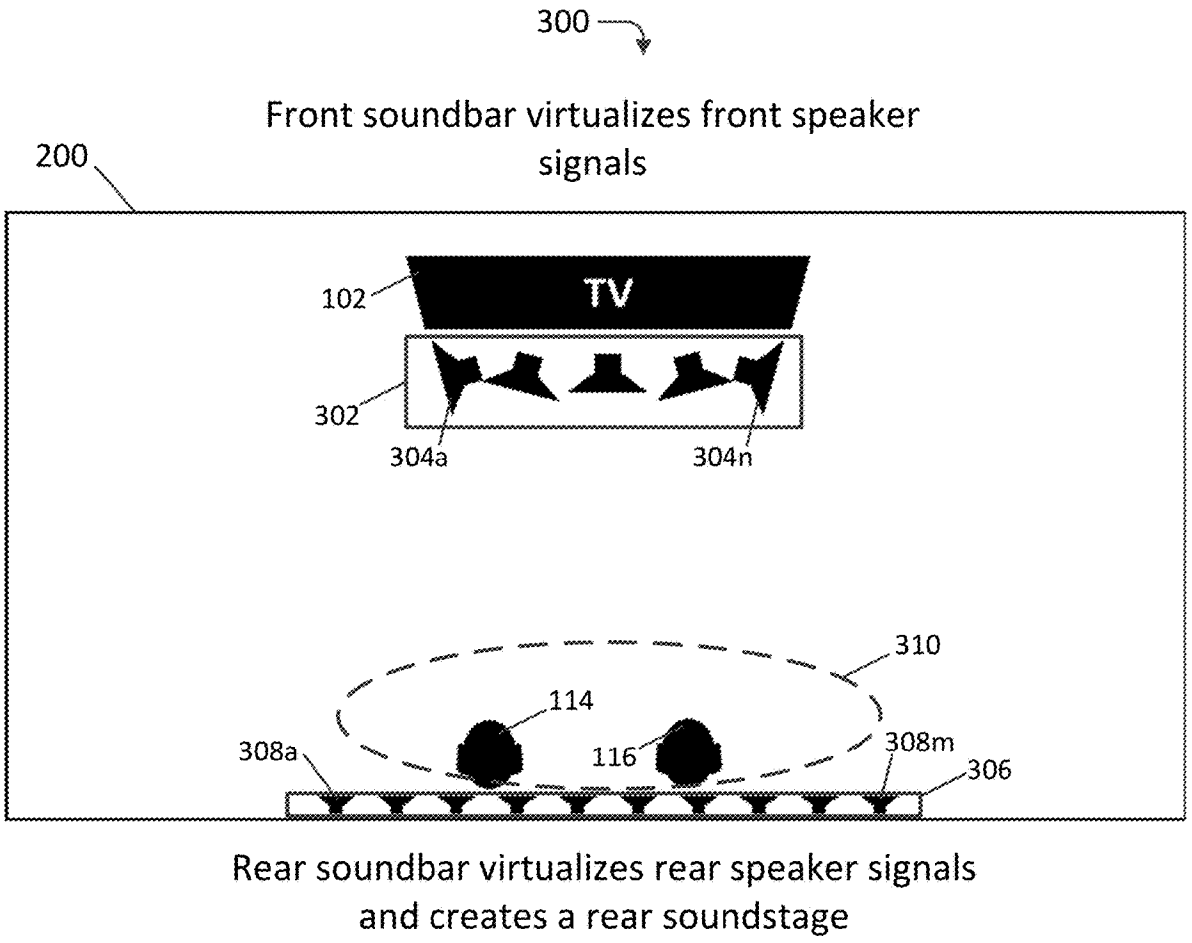
FIG. 3A illustrates an embodiment for providing an immersive listening area for a plurality of listeners using a rear sound bar.
Figure 4:
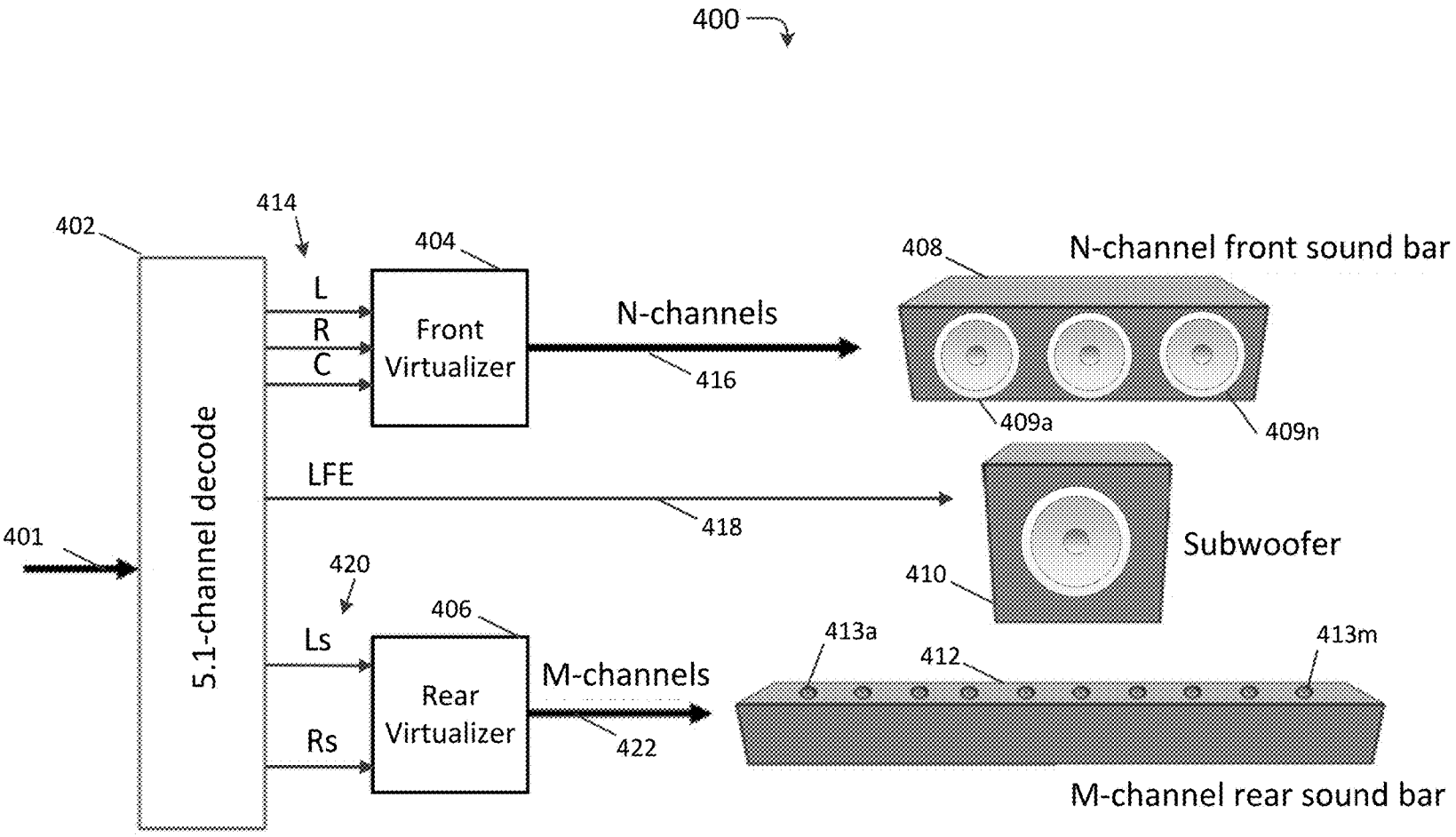
FIG. 4 illustrates an embodiment for providing an immersive listening area for a plurality of listeners using a rear sound bar.

FIG. 3A illustrates an embodiment of a system 300 for providing an immersive listening area for a plurality of listeners using a rear sound bar 306. In FIG. 3A a surround sound system is virtualized using a front sound bar 302 and a rear sound bar 306 in home theater room 200. Front sound bar 302 is an N-channel sound bar and includes speakers 304*a* . . . 304*n*, where in this example N=5. Front sound bar 302 may include software to virtualize signals to speakers 304*a* . . . 304*n* from, e.g., left (L), center (C), right (R), left surround (Ls), and right surround (Rs) input signals (not shown). In an embodiment, front sound bar 302 may also virtualize inputs to speakers 304*a* . . . 304*n* using additional input signals, such as left top front (Ltf) and right top front (Rtf), i.e., signals intended for height speakers. Rear sound bar 306 is an M-channel sound bar and includes speakers 308*a* . . . 308*m*, where in this example M=10. In FIG. 3A, speakers 304*a* . . . 304*n* are shown to be forward-firing. In other embodiments, one or more of speakers 304*a* . . . 304*n* may be oriented toward the side (as speakers 304*a* and 304*n* are), or may be upward firing as shown by speakers 413*a* . . . 413*m* (FIG. 4). Rear sound bar 306 may be located on the floor, at ear level, near the ceiling, or somewhere between.

Generally, the speakers of rear sound bar 306 may be oriented to direct sound toward the locations of the intended listeners, e.g., if floor-located, rear sound bar 306 may have upward firing speakers, or a combination of upward, forward, and side firing speakers; if ear-level located, rear sound bar 206 may have forward firing speakers, or a combination of forward, upward, downward, and side-firing speakers; and if ceiling-located, rear sound bar 306 may have downward-firing speakers, or a combination of downward, forward, and side-firing speakers.

In FIG. 3A, rear sound bar 306 is located behind and in close proximity to listeners 114, 116 in home theater room 200. Depending on the location and orientation of rear sound bar 306 and speakers 308*a* . . . 308*m*, listeners 114, 116 could experience sound directly from rear sound bar 306, as well as sound reflected off any wall or ceiling.

Rear sound bar 306 may process, e.g., left rear surround (Lrs) and right rear surround (Rrs) input signals (not shown), to provide virtualized signals for speakers 308*a* . . . 308*m*. In an embodiment, rear sound bar 306 may also process additional inputs signals such as left rear top (Lrt) and right rear top (Rrt). For virtualization, rear sound bar 306 receives input signals based on standard audio coding and performs additional audio processing such that, when used to drive speakers 308*a* . . . 308*m*, the virtualized speaker signals distribute and render a rear sound stage. In other words, a panning algorithm is applied to the standard audio coding that takes into account: the rear sound bar speaker configuration and orientation; the rear sound bar position in the environment; and the rear sound bar position with respect to the intended listener location. In the example of FIG. 3A the panning algorithm therefore takes into account: the number of speakers 308*a* . . . 308*m*, that they are linearly arranged, and that they are forward firing; that rear sound bar 306 is behind an intended position of listeners 114, 116, next to the rear wall of room 200, and floor mounted; and that the intended position of listeners 114, 116 is very near to rear sound bar 306.

Similarly a front sound stage is created as a result of the virtualization of the front speaker signals using front sound bar 302, by using discrete speakers, or with a combination of the two. The combination of the front and rear sound stages results in an immersive listening area 310 that may encompass both listeners 114, 116, providing an immersive listening area for each. When each listener is within the immersive listening area, each listener receives, more or less, an equivalent listening experience, which is preferably to the different listening experiences received by listeners 114, 116 in FIG. 2, who are outside of immersive listening area 202.

Figure 3B:
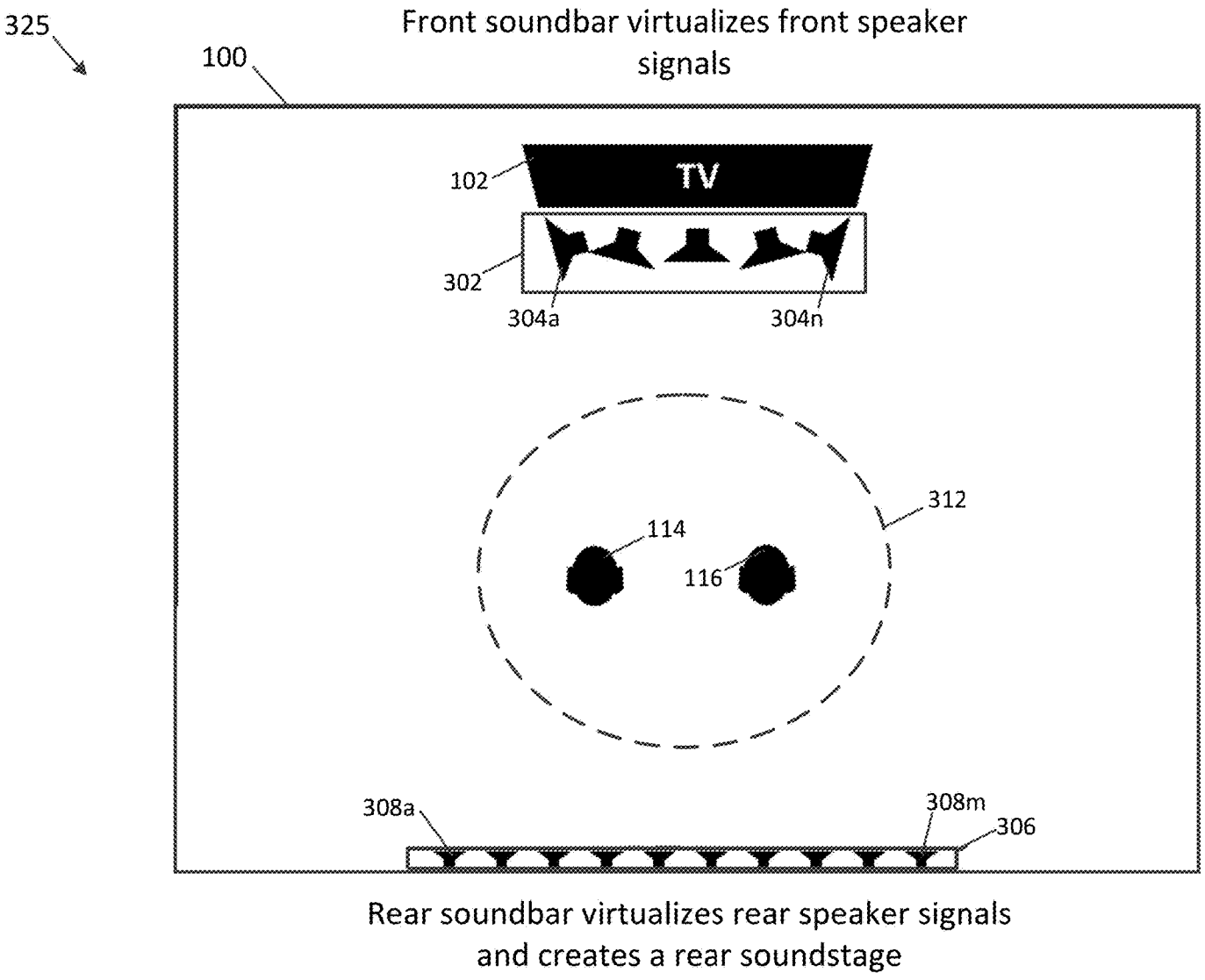
FIG. 3B illustrates an embodiment for providing an immersive listening area for a plurality of listeners using a rear sound bar.

FIG. 3B illustrates an embodiment of a system 325 for providing an immersive listening area for a plurality of listeners using a rear sound bar 306. In FIG. 3B a surround sound system is virtualized using a front sound bar 302 and a rear sound bar 306 in home theater room 100, which is larger than home theater room 200. Front sound bar 302 and rear sound bar 306 may be as described with reference to FIG. 3A.

In FIG. 3B, rear sound bar 306 is located behind and at a distance from listeners 114, 116 in home theater room 100. Where rear sound bar 306 is positioned at a distance from listeners 114, 116 rear sound bar 306 may process input signals differently, based on the distance. That is, in the example of FIG. 3B, the panning algorithm takes into account: the number of speakers 308*a* . . . 308*m*, that they are linearly arranged, and that they are forward firing; that rear sound bar 306 is behind an intended position of listeners 114, 116, next to the rear wall of room 200, and floor mounted; and that the intended position of listeners 114, 116 is at a distance from rear sound bar 306.

In FIG. 3B, as in FIG. 3A, a front sound stage is created as a result of the virtualization of the front speaker signals using front sound bar 302, by using discrete speakers (not shown), or with a combination of the two. The combination of the front and rear sound stages results in an immersive listening area 312 that may encompass both listeners 114, 116, providing an immersive listening experience to each. In an embodiment, front sound bar 302 of FIGS. 3A and 3B may be replaced by a front speaker bar (not shown), which does not receive virtualized speaker signals, but which may create a front sound stage.

Figure 3C:
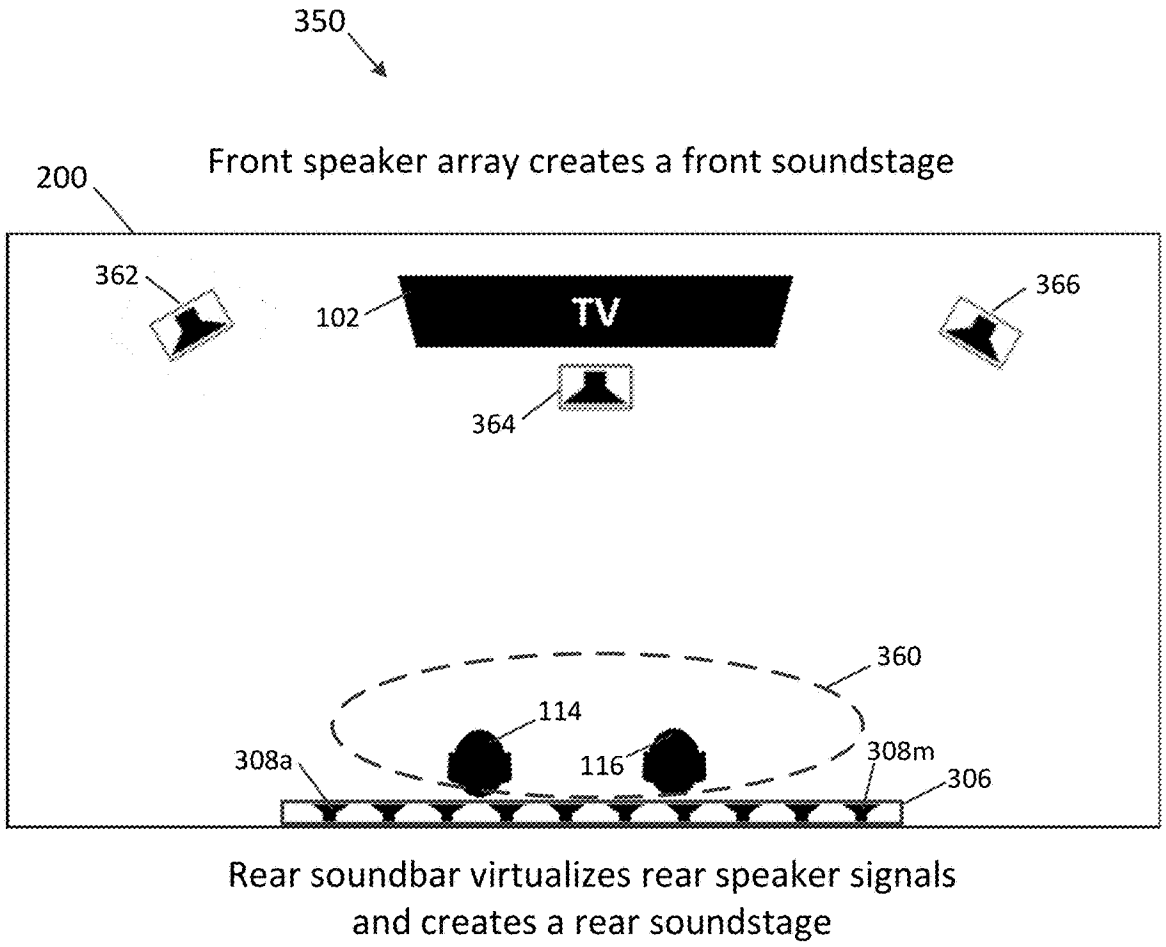
FIG. 3C illustrates an embodiment for providing an immersive listening area for a plurality of listeners using a rear sound bar.

FIG. 3C illustrates an embodiment of a system 350 for providing an immersive listening area for a plurality of listeners using a rear sound bar with a 5.0 multichannel signal playback. In FIG. 3C, rear sound bar 306 is located behind and at a distance from listeners 114, 116 in home theater room 200. The description of rear sound bar 306 is similar to that of FIG. 3A. In FIG. 3C, a front sound stage is created by using discrete speakers 362, 364, 366 without virtualization. The combination of the front and rear sound stages results in an immersive listening area 360 that may encompass both listeners 114, 116, providing an immersive listening experience to each.

FIG. 4 further illustrates an embodiment for providing an immersive listening area for a plurality of listeners using a rear sound bar. A data stream, e.g., data stream 401 (FIG. 4) and 501 (FIG. 5) may be an object based audio bit stream (such as a Dolby Atmos® format) or a channel-based immersive format. Where in FIG. 3A, FIGS. 3B, and 3C the numbers of front and rear audio channels were not specified, FIG. 4 illustrates an embodiment with 5.1 channel surround sound and an upward-firing rear sound bar 412. In FIG. 4, a data stream 401 (e.g., a compressed audio bitstream) is received by a 5.1-channel decoder 402. Decoder 402 decodes data stream 401 creating left (L), right (R), and center (C) input signals 414. A front virtualizer 404 receives input signals 414 and virtualizes output signals 416 which are suitable for playback on a sound bar 408 with N channels 409*a* . . . 409*n*. Decoder 402 further decodes data stream 401 creating left surround (Ls) and right surround (Rs) input signals 420. A rear virtualizer 406 receives input signals 420 and virtualizes output signals 422 which are suitable for playback on rear sound bar 412 with M channels 413*a* . . . 413*m*. Decoder 402 further decodes data stream 401 creating low frequency effects (LFE) output signal 418 which is suitable for playback on a subwoofer 410.

In embodiments, front sound bar 408 and rear sound bar 412 may be positioned within room 200 (FIG. 3A) or room 100 (FIG. 3B) similarly to front sound bar 302 and rear sound bar 306 to create immersive listening areas 310, 312 respectively. Subwoofer 410 may typically be placed within a room as desired without affecting the immersive listening area. In the example of FIG. 4 the panning algorithm takes into account that speakers 413*a* . . . 413*m* are upward firing. Otherwise, the considerations addressed by the panning algorithm include those discussed with reference to FIG. 3A and FIG. 3B.

In FIG. 4, rear sound bar 412 is shown with upward-firing drivers 413*a* . . . 413*m*. In an embodiment, rear sound bar 412 may virtualize rear speaker signals for forward-firing drivers. And in an embodiment, rear sound bar 412 may virtualize rear speaker signals for a combination of forward, upward, and side-firing drivers.

Figure 5:
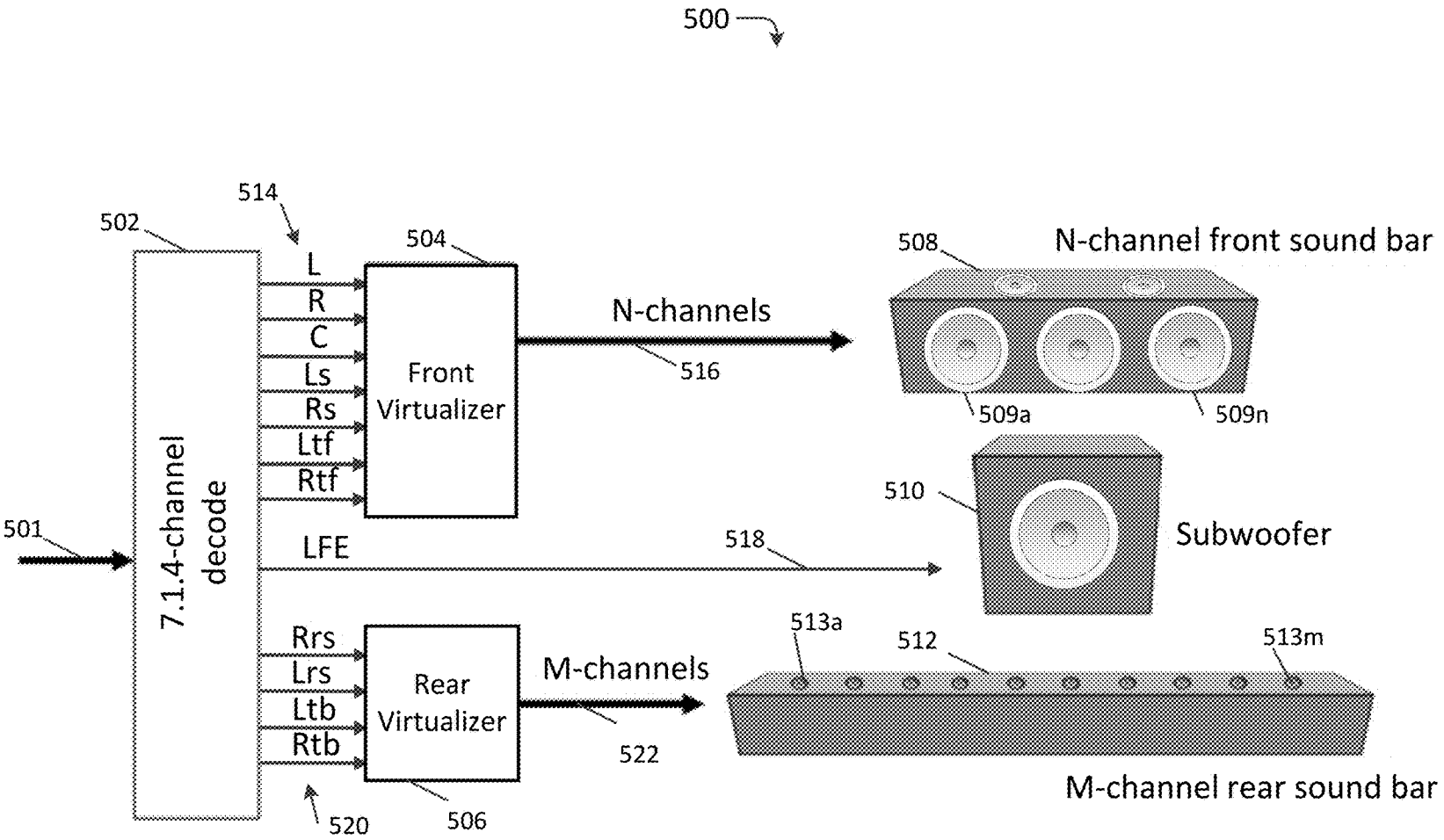
FIG. 5 illustrates an embodiment for providing an immersive listening area for a plurality of listeners using a rear sound bar.

FIG. 5 illustrates an embodiment for providing an immersive listening area for a plurality of listeners using a rear sound bar. Where FIG. 4 illustrated an embodiment with 5.1 channel surround sound, FIG. 5 illustrates an embodiment with 7.1.4 channel surround sound. In FIG. 5 channel-based height content in data stream 501 is decoded, rendered, and split by a 7.1.4-channel decoder 502 between a front sound bar 508 and a rear sound bar 512. Front heights are processed through the front sound bar with additional processing to virtualize height locations and rear height channels are processed in the rear-virtualizer and also have additional processing to add elevation. Decoder 502 decodes data stream 501 creating left (L), right (R), center (C), left surround (Ls), right surround (Rs), left top front (Ltf), and right top front (Rtf) input signals 514. A front virtualizer 504 receives input signals 514 and virtualizes output signals 516 which are suitable for playback on front sound bar 508 with N channels 509*a* . . . 509*n*. In this example, N=5. Front height inputs Ltf and Rtf receive additional processing from front virtualizer 504 to virtualize height locations using front sound bar 508. Front sound bar 508 includes two upward-firing speakers on the top of front sound bar 508 and illustrated between speaker 509*a* and 509*n*. These elevation speakers are configured to reflect sound from the ceiling and the signals they receive from front virtualizer 504 are processed accordingly. Decoder 502 further decodes data stream 501 creating right rear surround (Rrs), left rear surround (Lrs), left top rear (Ltr), and right top rear (Rtr) input signals 520.

In FIG. 5, a rear virtualizer 506 receives input signals 520 and virtualizes output signals 522 which are suitable for playback on rear sound bar 512 with M channels 513*a* . . . 513*m*. In this example, M=10. Rear height inputs Ltr and Rtr receive additional processing from rear virtualizer 506 to virtualize height locations using rear sound bar 512. Decoder 502 further decodes data stream 501 creating low frequency effects (LFE) output signal 518 which is suitable for playback on a subwoofer 510. In the embodiment, front sound bar 508 and rear sound bar 512 may be positioned within room 200 (FIG. 3A) or room 100 (FIG. 3B) similarly to front sound bar 302 and rear sound bar 306 to create immersive listening areas 310, 312 respectively. Subwoofer 510 may typically be placed within a room as desired without affecting an immersive listening area. In the example of FIG. 5 the panning algorithm employed by rear virtualizer 506 takes into account that input signals 520 include height inputs Ltr and Rtr. Otherwise, the considerations addressed by the panning algorithm include those discussed with reference to FIGS. 3A, 3B, and 4.

In FIG. 5, rear sound bar 512 is shown with upward-firing drivers 513*a* . . . 513*m*. In an embodiment, rear sound bar 512 may also virtualize rear speaker signals using forward-firing drivers. And in an embodiment, rear sound bar 512 may virtualize rear speaker signals using a combination of forward, upward, and side-firing drivers.

Figure 6:
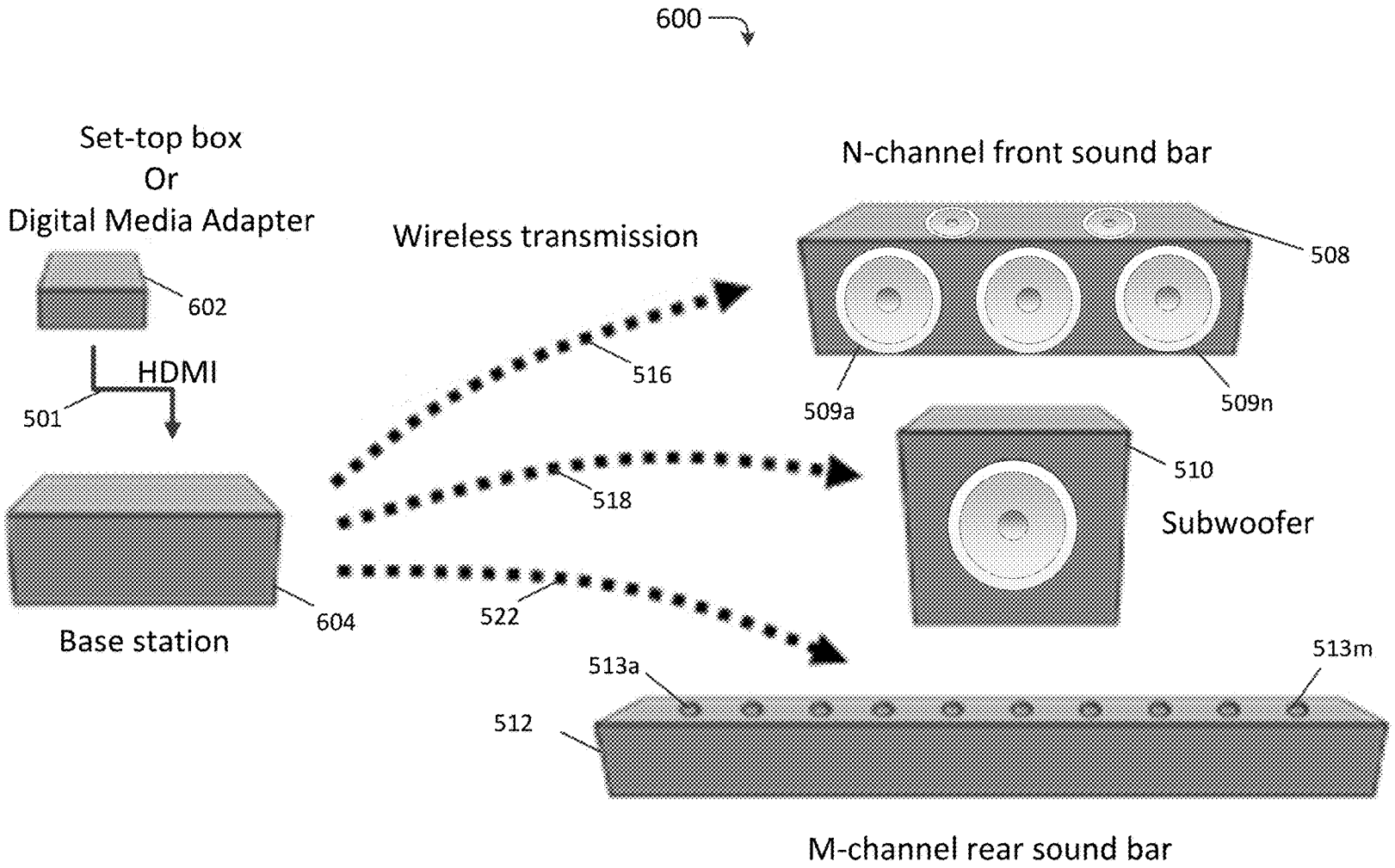
FIG. 6 illustrates an embodiment for providing an immersive listening area for a plurality of listeners using a rear sound bar.
Figure 7:
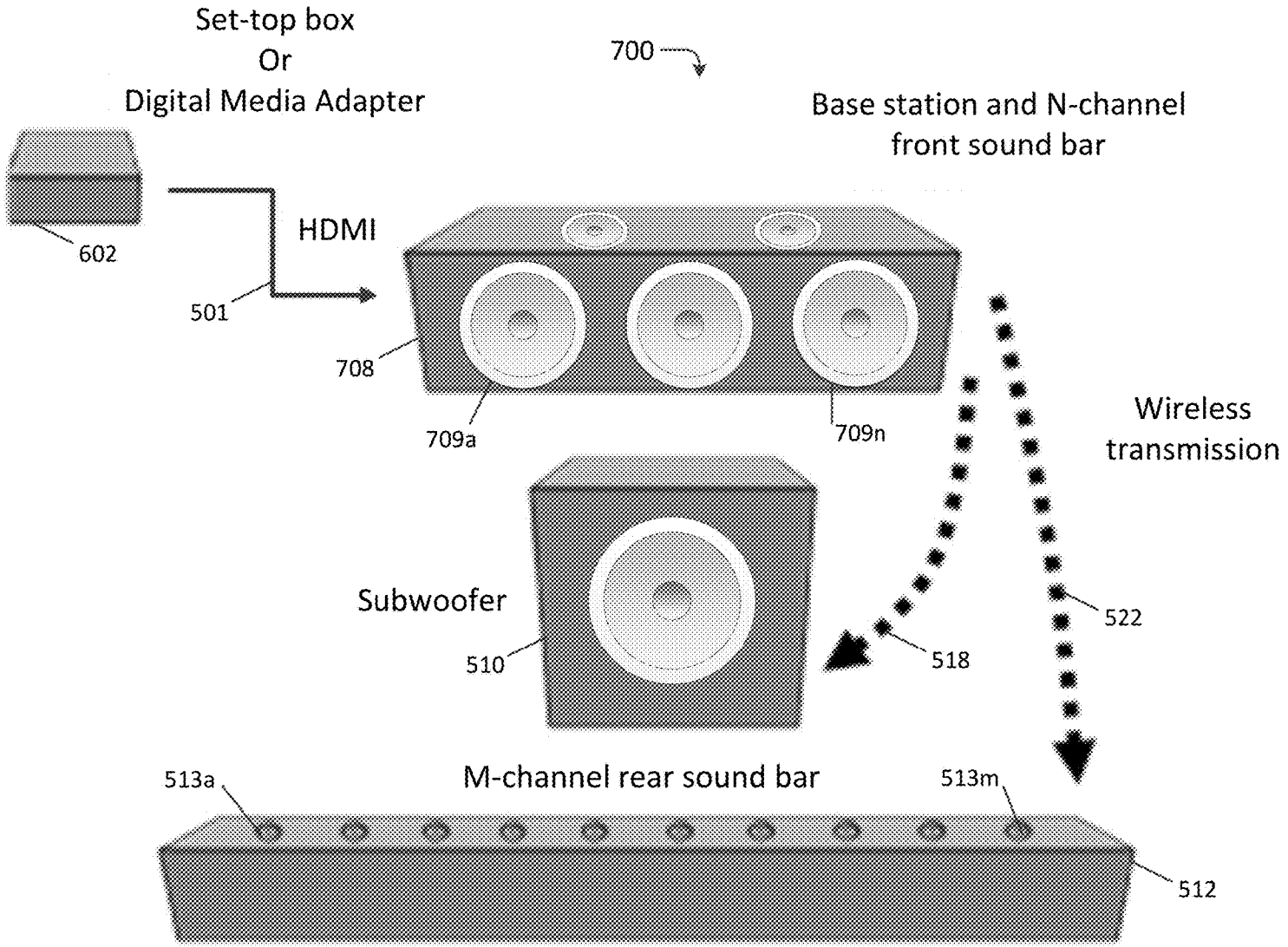
FIG. 7 illustrates an embodiment for providing an immersive listening area for a plurality of listeners using a rear sound bar.

FIGS. 6 and 7 illustrate embodiments for communicating with and controlling a rear sound bar, e.g., the rear sound bars of FIGS. 3-5. FIG. 6 illustrates an embodiment of a system 600 for providing an immersive listening area for a plurality of listeners using a rear sound bar. In FIG. 6, decoder 502 (FIG. 5) and virtualizers 504, 506 (FIG. 5) may be integrated into a base station 604. Base station 604 receives data stream 501, which in the embodiment is from an HDMI connection to a set-top box 602 (or, e.g., a streaming digital media adapter or optical disc player, such as a Blu-ray player). Base station 604, via decoder 502 and virtualizers 504, 506 creates output signals 516, 518, 522 and transmits these output signals wirelessly to front sound bar 508, subwoofer 510, and rear sound bar 512, respectively. The wireless transmission may be by Wi-Fi, Bluetooth, or other wireless transmission system. FIG. 6 thus illustrates that a base station could include front and rear virtualizers and a decoder. The base station may further include A/V synchronization capabilities. In an embodiment, output signals 516, 518, 522 may be transmitted through a wired connection.

FIG. 7 illustrates an embodiment of a system 700 for providing an immersive listening area for a plurality of listeners using a rear sound bar. In FIG. 7, decoder 502 (FIG. 5) and virtualizers 504, 506 (FIG. 5) may be integrated into a base station 708 that also includes an N-channel front soundbar with channels 709*a* . . . 709*n*. Base station 708 receives data stream 501, which in the embodiment is from an HDMI connection to a set-top box 602 (or, e.g., a streaming digital media adapter or optical disc player, such as a Blu-ray player). Base station 708, via decoder 502 and rear virtualizer 506 creates output signals 518, 522 and transmits these output signals wirelessly for playback on subwoofer 510, and rear sound bar 512, respectively. The wireless transmission may be by Wi-Fi, Bluetooth, or other wireless transmission system. Base station 708, via decoder 502 and front virtualizer 504, creates output signals 516 (not shown) for wired transmission and playback on the N-channel front sound bar that is integral to base station 708. Front height inputs Ltf and Rtf receive additional processing from front virtualizer 504 to virtualize height locations using the N-channel front sound bar, which includes two upward-firing speakers between speaker 709*a* and 709*n*. These elevation speakers are configured to reflect sound from the ceiling and the signals they receive from front virtualizer 504 are processed accordingly. FIG. 7 thus illustrates that a base station could include front and rear virtualizers and a decoder. The base station may further include A/V synchronization capabilities. In an embodiment, output signals 518, 522 may be transmitted through a wired connection.

Figure 8:
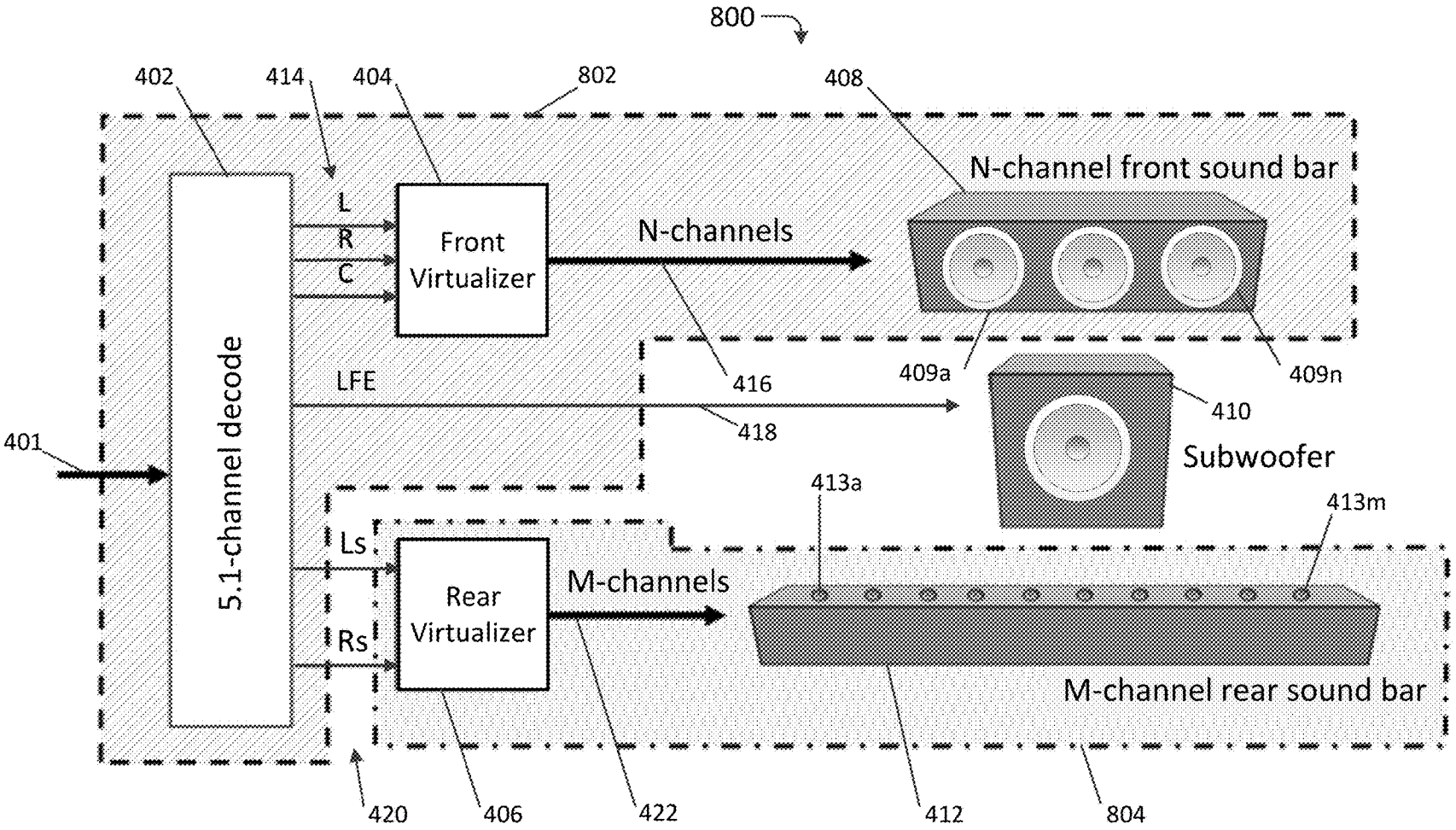
FIG. 8 illustrates an embodiment for providing an immersive listening area for a plurality of listeners using a rear sound bar.

FIG. 8 illustrates an embodiment of a system 800 for providing an immersive listening area for a plurality of listeners using a rear sound bar. FIG. 8 illustrates that the processing components, e.g., the decoders and virtualizers of FIGS. 4-7 may be separated and incorporated separately and arbitrarily into the elements of the system. In FIG. 8, system 800 splits virtualization processing between a front integrated unit 802 and a rear integrated unit 804. Front integrated unit 802 includes 5.1-channel decoder 402 (FIG. 4), front virtualizer 404 (FIG. 4), and front sound bar 408 (FIG. 4). Rear integrated unit 804 includes rear virtualizer 406 (FIG. 4) and rear sound bar 412 (FIG. 4). In this embodiment the main processing (including the decoding and front virtualization) is performed by decoder 402 and front virtualizer 404 within front integrated unit 802. To reduce bandwidth requirements of the transmission to the rear-sound bar, decoded Ls and Rs input signals 420 (FIG. 4) are transmitted over a wired or wireless connection to rear integrated unit 804. Inputs signals 420 are then processed by rear virtualizer 406 to create the M-channels for playback on rear sound bar 412. Note that, for the systems of FIGS. 5-7, if rear virtualizer 506 were incorporated into rear sound bar 512, then the wirelessly transmitted signals to rear sound bar 512 of FIGS. 6 and 7 would be rear input signals 520 rather than virtualized rear output signals 522.

Figure 9:
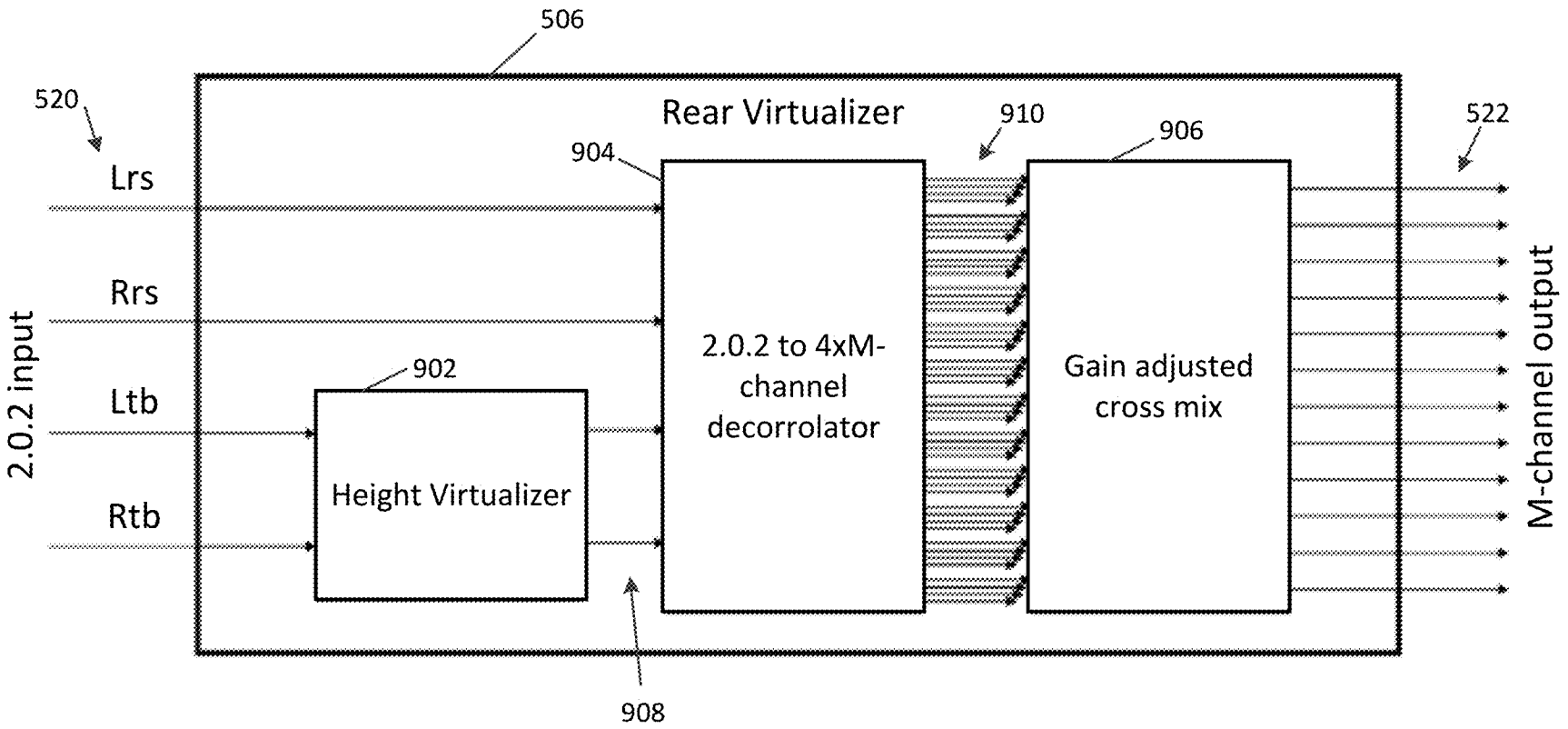
FIG. 9 is a schematic illustrating a rear virtualizer of an embodiment for providing an immersive listening area for a plurality of listeners using a rear sound bar.

FIG. 9 is a schematic illustrating processing blocks in a rear virtualizer of an embodiment for providing an immersive listening area for a plurality of listeners using a rear sound bar. FIG. 9 illustrates an exemplary embodiment of rear virtualizer 506 (FIG. 5). Rear virtualizer 506 may include a height virtualizer processing block 902, a 2.0.2 to 4×M-channel decorrolator processing block 904 and a gain-adjusted cross-mixer block 906 (which may also be called a "panner" or an "amplitude panner"). Height virtualizer 902 receives Ltb and Rtb input signals 520 and processes them into height virtualized signals 908, which are processed by decorrolator 904 and gain-adjusted cross-mixer 906 (or "panner 906") to increase the perception of elevation resulting from playback of M-channel output 522. Decorrolator 904 processes Lrs and Rrs input signals 520 and height virtualized signals 908 to create decorrolated signals 910.

Decorrolated signals 910 are processed by gain-adjusted cross-mixer 906 to create output signals 522 which are suitable for playback on rear sound bar 512 with M channels.

Virtualization for Speaker Arrays

In embodiments, a sound stage may be created by an array of discrete speakers, by virtualized signals sent to a soundbar, or by a combination of these. Generally, an array of discrete speakers and a speaker bar may each be called a type of "speaker array." Embodiments may virtualize a sound stage from a speaker array that is positioned in front of, behind, or a combination of in front of and behind the listeners, i.e., "about" the listeners. Embodiments may virtualize a sound stage where a speaker array is intended to be close to (e.g., less than one meter) or far from (e.g., typically greater than one and a half meters) the listeners. Embodiments may virtualize signals for a speaker array using discrete channels in a multichannel playback or using single objects in an object-based playback (such as Dolby Atmos®). In addition to the following methods of virtualization, it is envisioned that other methods of virtualization may achieve similar effects.

Figure 10:
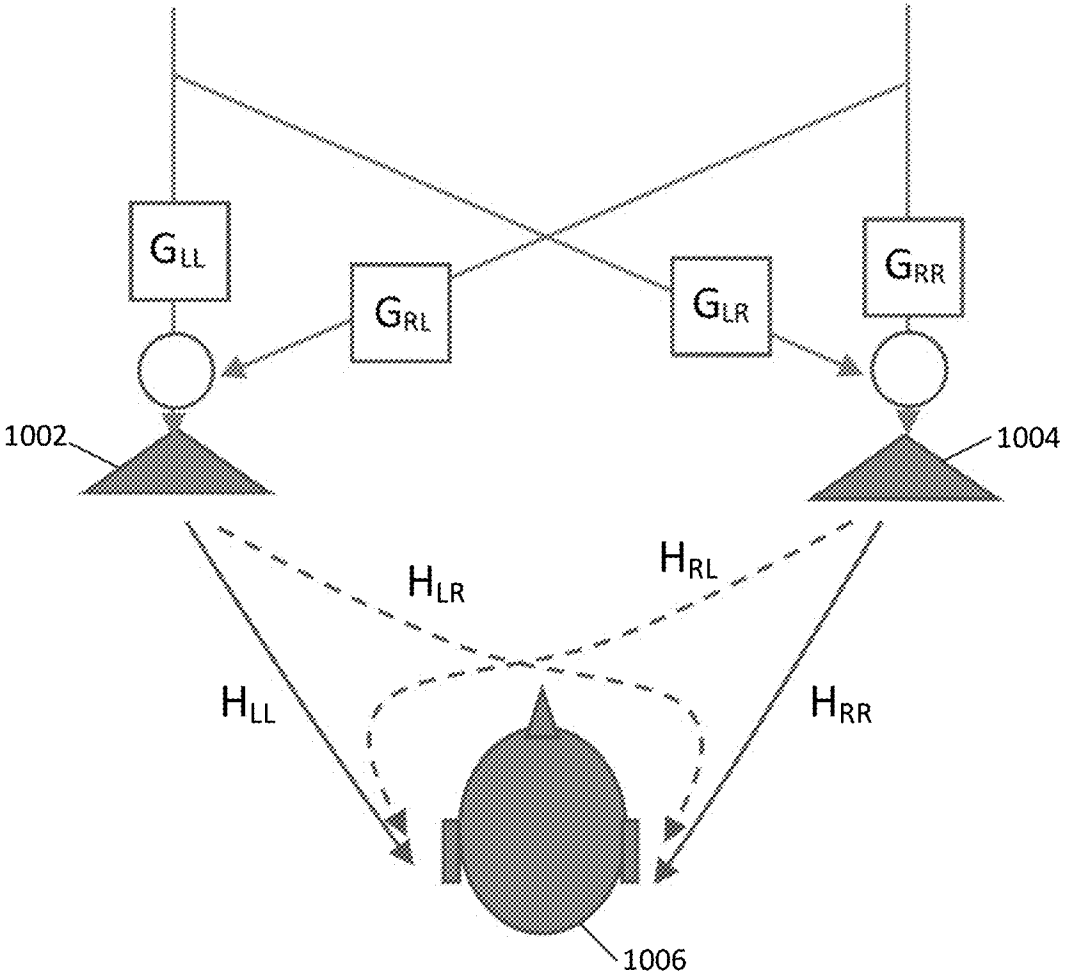
FIG. 10 is a schematic illustrating speaker virtualization using cross talk cancellation.

FIG. 10 is a schematic illustrating speaker virtualization using cross talk cancellation. A cross talk cancellation algorithm works by attempting to remove the leakage between a speaker on one side and the opposite-side ear of the listener. For example, leakage from a right channel output driver 1004 and a listener's 1006 left ear is designated HRL. Similarly, leakage from a left channel output driver 1002 and a listener's 1006 right ear is designated $H_{LR}$. The negative effect of leakage is that it draws the stereo image towards the center of the listener's perceived view of the soundstage, which decreases the listener's ability to distinguish clearly between left and right. To reduce or prevent leakage, a cross talk cancellation algorithm accounts for Head Related Transfer Functions (HRTF) between each speaker and the listeners' ears (also shown in matrix H(z), below). The cross talk algorithm applies inverse functions (e.g., $G_{LR}$) to an output signal (e.g., $G_{RR}$) to additively cancel out the leakage signals.

$$H(z) = \begin{bmatrix} H_{LL} & H_{LR} \\ H_{RL} & H_{RR} \end{bmatrix}$$

$$G(z) = \begin{bmatrix} G_{LL} & G_{LR} \\ G_{RL} & G_{RR} \end{bmatrix}$$

Cross talk cancellation algorithms (or "cross talk cancellers") are effective at creating a wider stereo image from a small device. They are employed as part of the virtualization on many consumer electronic devices—including TVs, mobile phones, laptops, and soundbars.

Because a cross talk canceller may be configured to use any HRTF they are suitable for speaker arrays (soundbars, discrete arrays, or combinations thereof) that are intended to be used in front of, behind, or above the listener. When the speaker array is closer to the listener, the variation in the HRTF approximation is more sensitive to perceivable "errors" in the cross talk cancellation. For this reason, cross talk cancellers are more suitable for providing virtualization in situations when the speaker array is intended to be further away from the listeners, such that variations in the listener's position are relatively small compared to the listening distance. Cross talk cancellers, however, may be employed effectively for virtualization when the speaker array is in close proximity to the listener when the listener is relatively stationary.

Figure 11:
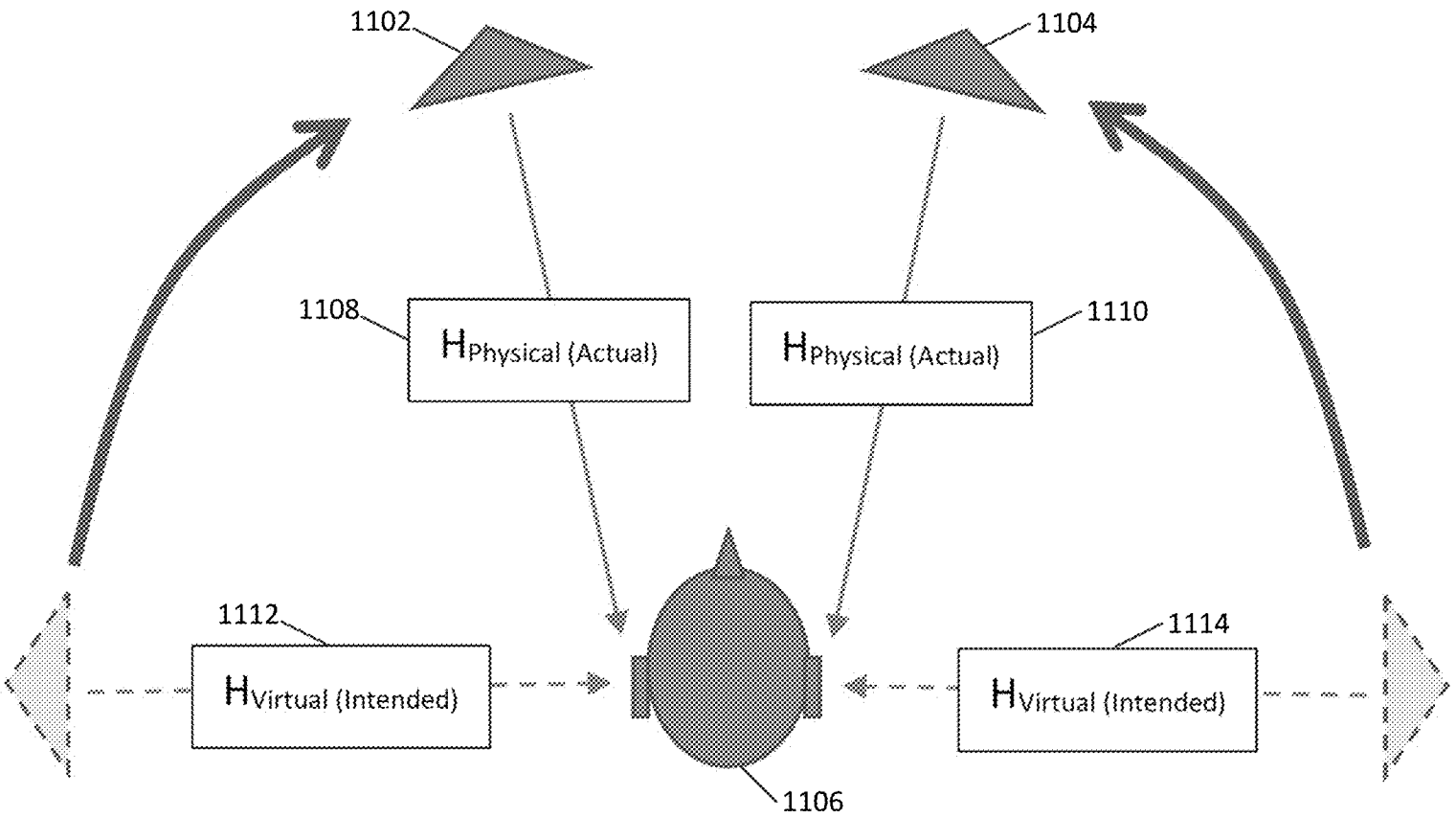
FIG. 11 is a schematic illustrating speaker virtualization using binauralization.

FIG. 11 is a schematic illustrating speaker virtualization using binauralization. A binauralization algorithm is a method of compensating for a difference between a speaker's 1106 actual location 1108, 1110 with respect to speakers 1102, 1104 and the virtualized (or "intended") location 1112, 1114. Binauralization is typically employed for virtualization using a soundbar in a home theater, e.g., a living room, where the soundbar (or other speaker array) at the front of the room is attempting to replicate the sound of a speaker which should be beside the listener.

A binauralization algorithm compensates for the real location by applying, to an output signal, an inverse of the actual HTRF (from the speaker to the listener) and applying an additional HRTF to create a virtualized signal to simulate the sound of the sound source as if it were in the intended location. A binauralization algorithm may be added to, or used in combination with, a cross talk cancellation algorithm.

Figure 12:
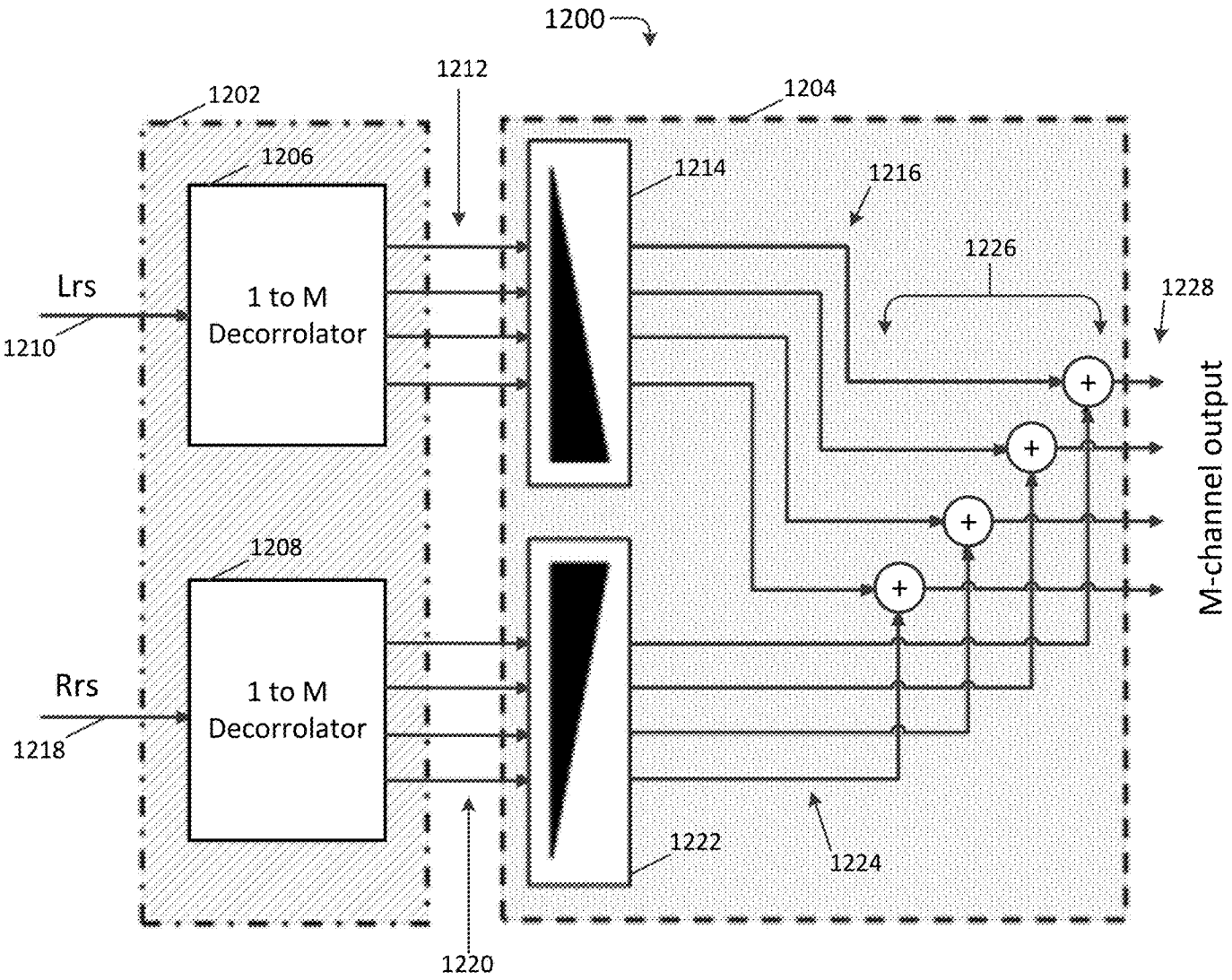
FIG. 12 is a schematic illustrating speaker virtualization using diffuse panning.

FIG. 12 is a schematic illustrating speaker virtualization using diffuse panning. A diffuse panning algorithm may be employed to create an immersive zone for listeners in the situation where a speaker array is located close to (e.g., less than one meter from) multiple listeners. The purpose of using a diffuse panning algorithm is not to recreate an entirely accurate localization of the original sounds, but instead to create a reasonably immersive effect for each of the multiple listeners by ensuring that a general localization of sounds is preserved for each of the multiple listeners.

A rear virtualizer 1200 using a diffuse panning algorithm may create an array of decorrolated outputs, e.g., outputs 1212, from a single original sound source, e.g., signal 1210, and pan them around the listeners. The result is that each listener within the immersive listening area has a general sense of spatial direction for the source. The single sound source could be a single channel in a multichannel playback or a single object in an object-based playback (such as Dolby Atmos®).

A sense of general spatial direction may be achieved by scaling the array of decorrolated outputs along the length of a speaker array with a linear ramping of gains. The linear ramp may cause some of the spatial accuracy of the sound source to become more diffuse. However, ramped, decorrolated, and cross-mixed output 1228 may provide a significant increase in the size of the immersive zone for the listeners.

Figure 13:
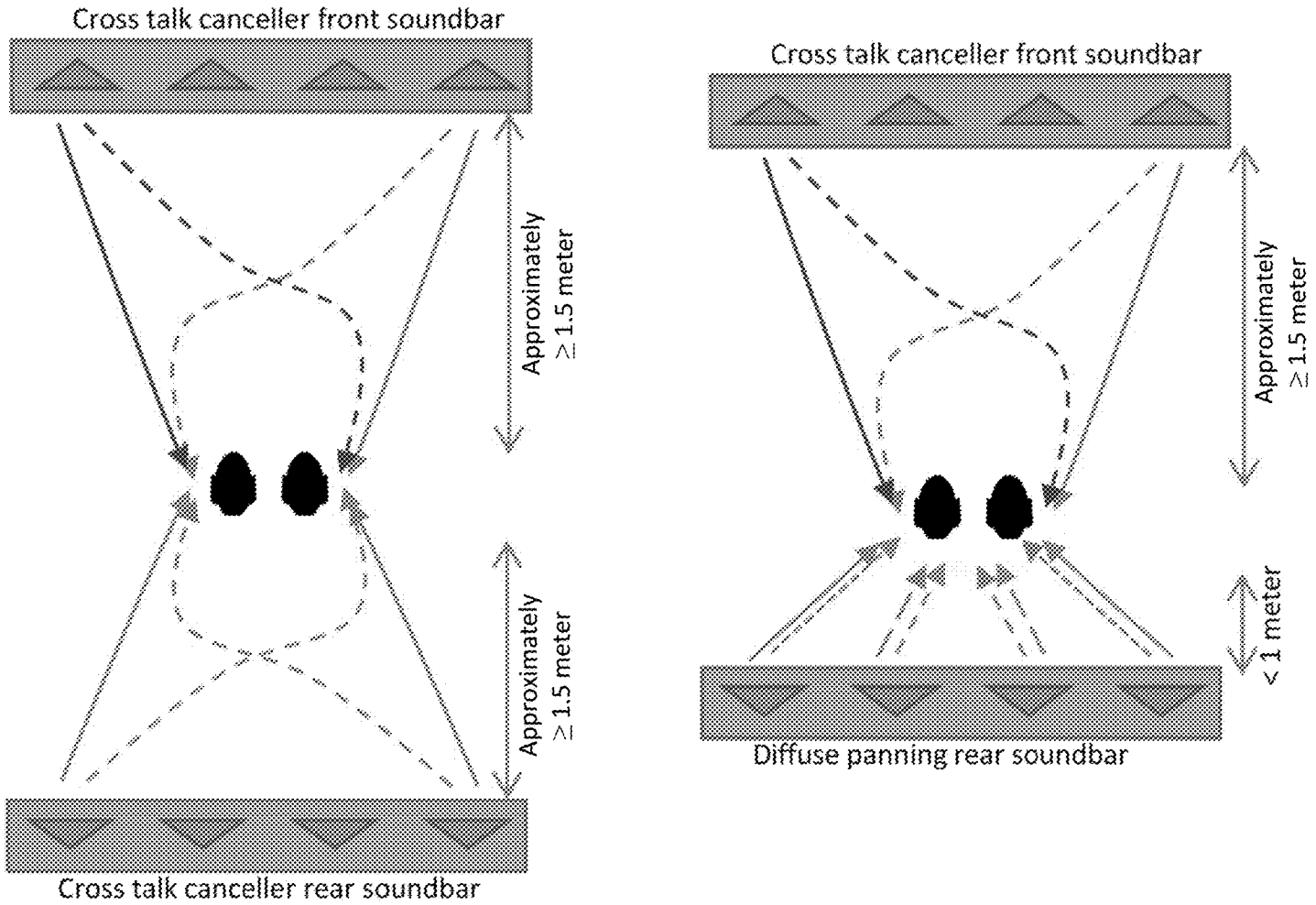
FIG. 13 is a schematic illustrating an example of using different methods of virtualization depending on the distance of the sound bar from a listener.

Because diffuse panning increases the size of an immersive listening area, it is ideal for a speaker array positioned close to (e.g., less than one meter from) a group of listeners. The diffuse panning virtualizer may be used in front or behind the listeners however it may be more appropriate to use this setup behind the listeners when paired with a discrete speaker or cross talk cancelling and binaruralizing front sound bar. For these reasons, the embodiments described with reference to FIG. 3A and FIG. 3C may employ diffuse panning beneficially in rear soundbar 306. Similarly, the embodiments described with reference to FIGS. 3B, and 4-8 may employ diffuse panning beneficially in the front and rear soundbars, depending on the intended distances of the front and rear soundbars from the listeners. FIG. 13 is a schematic illustrating the use of different methods of virtualization depending on the distance of the sound bar from a listener.

Returning to FIG. 12. FIG. 12 is a schematic illustrating processing blocks in a rear virtualizer 1200 using diffuse panning to process a left rear surround (Lrs) signal 1210 and a right rear surround (Rrs) signal 1218, which may be signals Lrs and Rrs from signals 520 (FIG. 5). In FIG. 12, rear virtualizer 1200 includes a decorrolator block 1202 and a panning and mixing block 1204. Decorrolator block 1202 includes 1 to M decorrolators 1206 and 1208. Panning and mixing block 1204 includes panners 1214 and 1222 and cross-mixer 1226 (including each of the summed intersections of signals 1216 with signals 1224). In FIG. 12, left rear surround signal 1210 and right rear surround signal 1218 are processed by decorrolators 1206, 1208, to create M output signals 1212, 1220 respectively (in this example, M=4). Output signals 1212, 1220 are processed by panners 1214, 1222, creating panned output signals 1216, 1224, respectively. Ramped and decorrolated output signals 1216, 1224 are cross-mixed by mixing block 1204 to create output signals 1228 which are suitable for playback on a rear sound bar with M channels.

In the various embodiments, the number and configuration of the speakers and sound bars are provided as examples and should not be understood as limiting. Other embodiments may include more or fewer speakers and different configurations, e.g., forward, upward, and side-firing drivers, and may have the soundbar located at different heights and directed at different points in a room.

Figure 14:
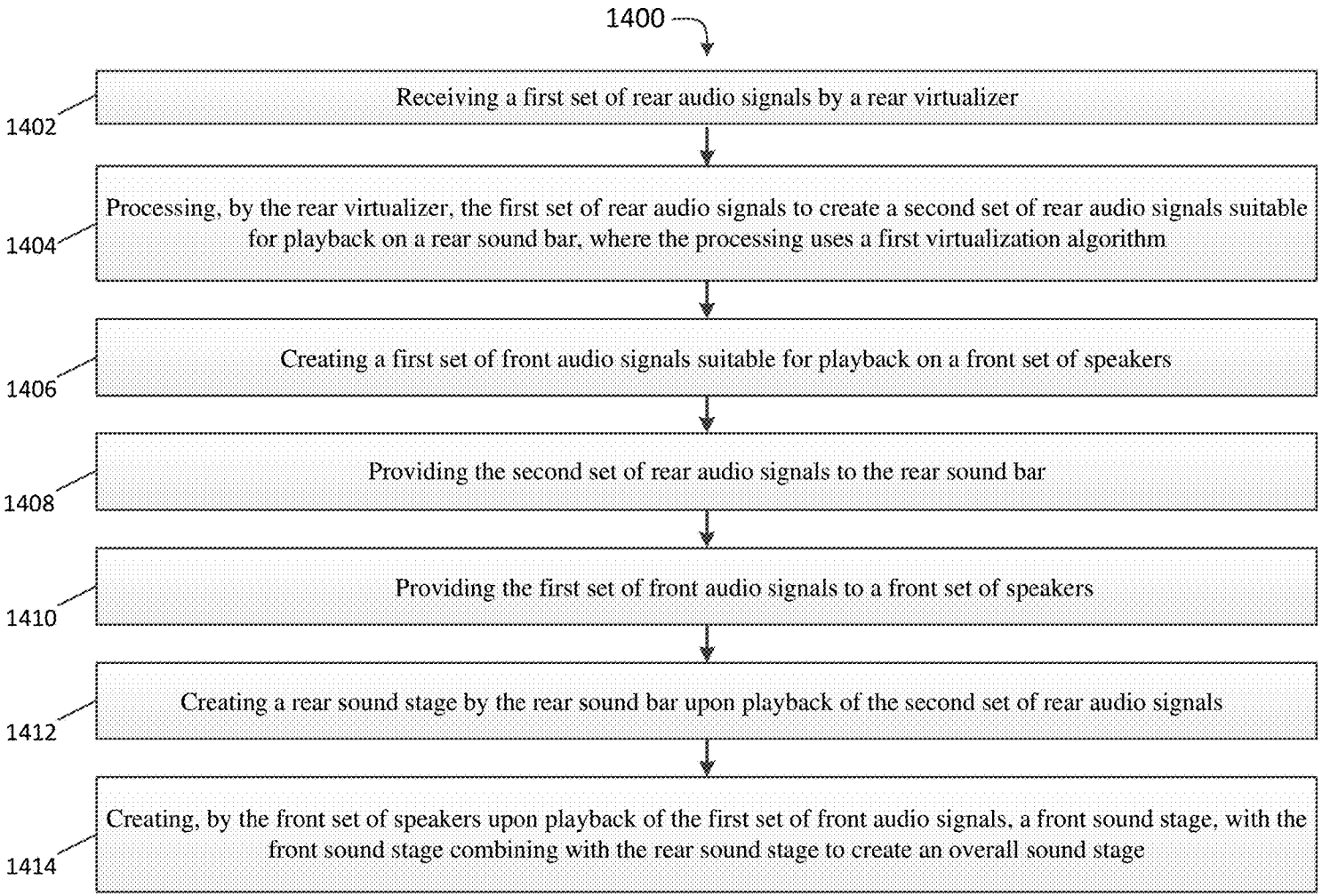
FIG. 14 is a flow diagram of an embodiment for providing an immersive listening area for a plurality of listeners using a rear sound bar.

FIG. 14 is a flow diagram of an embodiment of a method 1400 for providing an immersive listening area for a plurality of listeners using a rear sound bar. In FIG. 14, in step 1402, a first set of rear audio signals is received by a virtualizer. In step 1404, the received first set rear audio signals are processed by the rear virtualizer to create a second set of rear audio signals suitable for playback on a rear sound bar. The processing in step 1404 uses a first virtualization algorithm. And in step 1406, a first set of front signals suitable for playback on a front set of speakers is created. Method 1400 optionally continues with steps 1408 through 1414. In step 1408, the second set of rear audio signals is provided to the rear sound bar. In step 1410, the first set of front audio signals is provided to a front set of speakers. In step 1412, a rear sound stage is created by the rear sound bar upon playback of the second set of rear audio signals. And in step 1414, a front sound stage is created by the front set of speakers upon playback of the first set of front audio signals, with the front sound stage and the rear sound stage combining to create an overall sound stage.

The embodiments show that the functions performed by the various components of embodiments may be divided and re-located. These embodiments are exemplary of the multitude of potential configurations for any embodiment and do not limit the potential configurations in any way.

Figure 15:
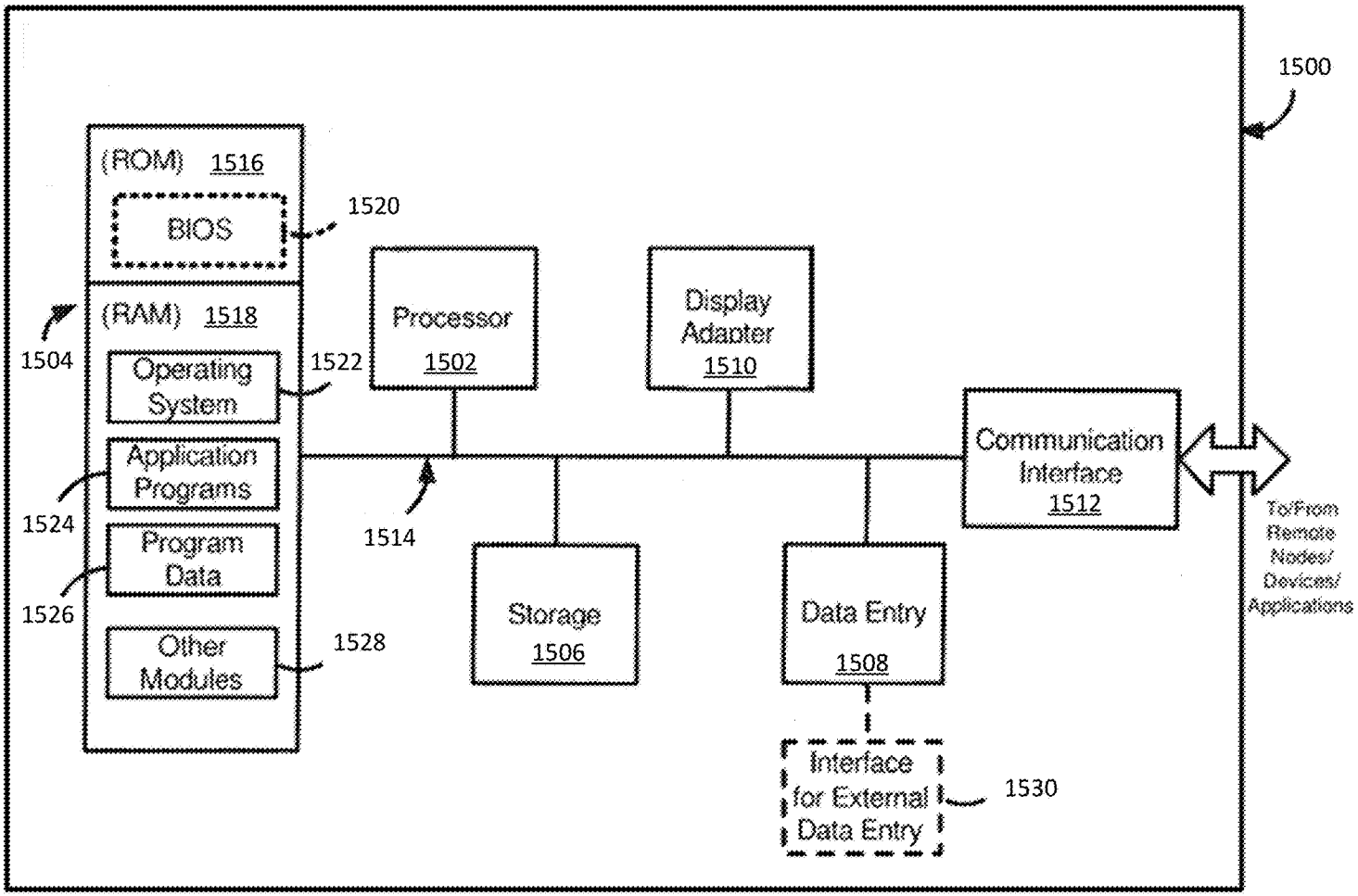
FIG. 15 is a block diagram of an exemplary system for providing an immersive listening area for a plurality of listeners using a rear sound bar.

FIG. 15 is a block diagram of an exemplary system for providing an immersive listening area for a plurality of listeners using a rear sound bar with various embodiments of the present invention. With reference to FIG. 15, an exemplary system for implementing the subject matter disclosed herein, including aspects of the methods described above, includes a hardware device 1500, including a processing unit 1502, memory 1504, storage 1506, data entry module 1508, display adapter 1510, communication interface 1512, and a bus 1514 that couples elements 1504-1512 to the processing unit 1502.

The bus 1514 may comprise any type of bus architecture. Examples include a memory bus, a peripheral bus, a local bus, etc. The processing unit 1502 is an instruction execution machine, apparatus, or device and may comprise a microprocessor, a digital signal processor, a graphics processing unit, an application specific integrated circuit (ASIC), a field programmable gate array (FPGA), etc. The processing unit 1502 may be configured to execute program instructions stored in memory 1504 and/or storage 1506 and/or received via data entry module 1508.

The memory 1504 may include read only memory (ROM) 1516 and random access memory (RAM) 1518. Memory 1504 may be configured to store program instructions and data during operation of device 1500. In various embodiments, memory 1504 may include any of a variety of memory technologies such as static random access memory (SRAM) or dynamic RAM (DRAM), including variants such as dual data rate synchronous DRAM (DDR SDRAM), error correcting code synchronous DRAM (ECC SDRAM), or RAMBUS DRAM (RDRAM), for example. Memory 1504 may also include nonvolatile memory technologies such as nonvolatile flash RAM ( ) or ROM. Memory 1504 may include non-printed material. In some embodiments, it is contemplated that memory 1504 may include a combination of technologies such as the foregoing, as well as other technologies not specifically mentioned. When the subject matter is implemented in a computer system, a basic input/output system (BIOS) 1520, containing the basic routines that help to transfer information between elements within the computer system, such as during start-up, is stored in ROM 1516.

The storage 1506 may include a flash memory data storage device for reading from and writing to flash memory, a hard disk drive for reading from and writing to a hard disk, a magnetic disk drive for reading from or writing to a removable magnetic disk, and/or an optical disk drive for reading from or writing to a removable optical disk such as a CD ROM, DVD or other optical media. The drives and their associated computer-readable media provide nonvolatile storage of computer readable instructions, data structures, program modules and other data for the hardware device 1500.

It is noted that the methods described herein can be embodied in executable instructions stored in a non-transitory computer readable medium for use by or in connection with an instruction execution machine, apparatus, or device, such as a computer-based or processor-containing machine, apparatus, or device. It will be appreciated by those skilled in the art that for some embodiments, other types of computer readable media may be used which can store data that is accessible by a computer, such as magnetic cassettes, flash memory cards, digital video disks, Bernoulli cartridges, RAM, ROM, and the like may also be used in the exemplary operating environment. As used here, a "computer-readable medium" can include one or more of any suitable media for storing the executable instructions of a computer program in one or more of an electronic, magnetic, optical, and electromagnetic format, such that the instruction execution machine, system, apparatus, or device can read (or fetch) the instructions from the computer readable medium and execute the instructions for carrying out the described methods. A non-exhaustive list of conventional exemplary computer readable medium includes: a portable computer diskette; a RAM; a ROM; an erasable programmable read only memory (EPROM or flash memory); optical storage devices, including a portable compact disc (CD), a portable digital video disc (DVD), a BLU-RAY disc; and the like.

A number of program modules may be stored on the storage 1506, ROM 1516 or RAM 1518, including an operating system 1522, one or more applications programs 1524, program data 1526, and other program modules 1528. A user may enter commands and information into the hardware device 1500 through data entry module 1508. Data entry module 1508 may include mechanisms such as a keyboard, a touch screen, a pointing device, etc. Other external input devices (not shown) are connected to the hardware device 1500 via external data entry interface 1530. By way of example and not limitation, external input devices may include a microphone, joystick, game pad, satellite dish, scanner, or the like. In some embodiments, external input devices may include video or audio input devices such as a video camera, a still camera, etc. Data entry module 1508 may be configured to receive input from one or more users of device 1500 and to deliver such input to processing unit 1502 and/or memory 1504 via bus 1514.

The hardware device 1500 may operate in a networked environment using logical connections to one or more remote nodes (not shown) via communication interface 1512. The remote node may be another computer, a server, a router, a peer device or other common network node, and typically includes many or all of the elements described above relative to the hardware device 1500. The communication interface 1512 may interface with a wireless network and/or a wired network. Examples of wireless networks include, for example, a BLUETOOTH network, a wireless personal area network, a wireless 802.11 local area network (LAN), and/or wireless telephony network (e.g., a cellular, PCS, or GSM network). Examples of wired networks include, for example, a LAN, a fiber optic network, a wired personal area network, a telephony network, and/or a wide area network (WAN). Such networking environments are commonplace in intranets, the Internet, offices, enterprise-wide computer networks and the like. In some embodiments, communication interface 1512 may include logic configured to support direct memory access (DMA) transfers between memory 1504 and other devices.

In a networked environment, program modules depicted relative to the hardware device 1500, or portions thereof, may be stored in a remote storage device, such as, for example, on a server. It will be appreciated that other hardware and/or software to establish a communications link between the hardware device 1500 and other devices may be used.

It should be understood that the arrangement of hardware device 1500 illustrated in FIG. 15 is but one possible implementation and that other arrangements are possible. It should also be understood that the various system components (and means) defined by the claims, described above, and illustrated in the various block diagrams represent logical components that are configured to perform the functionality described herein. For example, one or more of these system components (and means) can be realized, in whole or in part, by at least some of the components illustrated in the arrangement of hardware device 1500. In addition, while at least one of these components are implemented at least partially as an electronic hardware component, and therefore constitutes a machine, the other components may be implemented in software, hardware, or a combination of software and hardware. More particularly, at least one component defined by the claims is implemented at least partially as an electronic hardware component, such as an instruction execution machine (e.g., a processor-based or processor-containing machine) and/or as specialized circuits or circuitry (e.g., discrete logic gates interconnected to perform a specialized function), such as those illustrated in FIG. 15. Other components may be implemented in software, hardware, or a combination of software and hardware. Moreover, some or all of these other components may be combined, some may be omitted altogether, and additional components can be added while still achieving the functionality described herein. Thus, the subject matter described herein can be embodied in many different variations, and all such variations are contemplated to be within the scope of what is claimed.

In the description above, the subject matter may be described with reference to acts and symbolic representations of operations that are performed by one or more devices, unless indicated otherwise. As such, it will be understood that such acts and operations, which are at times referred to as being computer-executed, include the manipulation by the processing unit of data in a structured form. This manipulation transforms the data or maintains it at locations in the memory system of the computer, which reconfigures or otherwise alters the operation of the device in a manner well understood by those skilled in the art. The data structures where data is maintained are physical locations of the memory that have particular properties defined by the format of the data. However, while the subject matter is being described in the foregoing context, it is not meant to be limiting as those of skill in the art will appreciate that various of the acts and operation described hereinafter may also be implemented in hardware.

For purposes of the present description, the terms "component," "module," and "process," may be used interchangeably to refer to a processing unit that performs a particular function and that may be implemented through computer program code (software), digital or analog circuitry, computer firmware, or any combination thereof.

It should be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

In the description above and throughout, numerous specific details are set forth in order to provide a thorough understanding of the disclosure. It will be evident, however, to one of ordinary skill in the art, that the disclosure may be practiced without these specific details. In other instances, well-known structures and devices are shown in block diagram form to facilitate explanation. The description of the preferred an embodiment is not intended to limit the scope of the claims appended hereto. Further, in the methods disclosed herein, various steps are disclosed illustrating some of the functions of the disclosure. One will appreciate that these steps are merely exemplary and are not meant to be limiting in any way. Other steps and functions may be contemplated without departing from this disclosure.

What is claimed is:

1. A method for a providing an immersive listening area, comprising:

receiving, by a rear virtualizer, a first set of rear audio signals;

processing, by the rear virtualizer, the first set of rear audio signals to create a second set of rear audio signals suitable for playback on a rear sound bar, the processing using a first virtualization algorithm and including the steps of:

decorrolating the received first set of rear audio signals to create a decorrolated set of rear audio signals based on a number of channels in the rear sound bar;

gain-adjusting the decorrolated set of rear audio signals to create a gain-adjusted set of rear audio signals, and cross-mixing the gain-adjusted set of rear audio signals to create the second set of rear audio signals; and creating a first set of front audio signals suitable for playback on a front set of speakers.

2. The method of claim 1, wherein the first virtualization algorithm accounts for:

a speaker configuration of the rear sound bar, an intended location of the rear sound bar being behind a listener, and an intended distance of the listener from the rear sound bar.

3. The method of claim 2, wherein the intended location of the rear sound bar includes being adjacent to a rear wall, and wherein the intended distance of the listener from the rear sound bar is within a pre-determined distance.

4. The method of claim 3, further comprising:

providing the second set of rear audio signals to the rear sound bar;

providing the first set of front audio signals to a front set of speakers;

creating, by the rear sound bar upon playback of the second set of rear audio signals, a rear sound stage; and creating, by the front set of speakers upon playback of the first set of front audio signals, a front sound stage, wherein the front sound stage combines with the rear sound stage to create an overall sound stage.

5. The method of claim 4, wherein the front set of speakers is included within a front sound bar, wherein the first set of front audio signals are front audio signals suitable for playback on the front sound bar, and wherein the first set of front audio signals are created by:

processing, by a front virtualizer, an initial set of front audio signals to create the first set of front audio signals, the processing using a second virtualization algorithm that accounts for:

a speaker configuration of the front sound bar, and an intended distance of the listener from the front sound bar.

6. The method of claim 1, wherein the processing, by the rear virtualizer, the first set of rear audio signals to create a second set of rear audio signals suitable for playback on a rear sound bar includes:

processing, by a rear height virtualizer, a subset of the received first set of rear audio signals;

not processing, by the rear height virtualizer, the remainder of the received first set of rear audio signals;

and then, using the first virtualization algorithm:

decorrolating the processed subset and the remainder of the received first set of rear audio signals to create a decorrolated set of rear audio signals based on a number of channels in the rear sound bar, gain-adjusting the decorrolated set of rear audio signals to create a gain-adjusted set of rear audio signals, and cross-mixing the gain-adjusted set of rear audio signals to create the second set of rear audio signals.

7. The method of claim 1, wherein the first virtualization algorithm employs at least one of: cross talk cancellation, binauralization, and diffuse panning.

8. An audio processing unit, including a memory and a processor, the memory including instructions which when executed by the processor perform a method for providing an immersive listening area, the method comprising:

receiving, by a rear virtualizer, a first set of rear audio signals;

processing, by the rear virtualizer, the first set of rear audio signals to create a second set of rear audio signals suitable for playback on a rear sound bar, the processing using a first virtualization algorithm and including the steps of:

decorrolating the received first set of rear audio signals to create a decorrolated set of rear audio signals based on a number of channels in the rear sound bar;

gain-adjusting the decorrolated set of rear audio signals to create a gain-adjusted set of rear audio signals, and cross-mixing the gain-adjusted set of rear audio signals to create the second set of rear audio signals; and creating a first set of front audio signals suitable for playback on a front set of speakers.

9. The audio processing unit of claim 8 wherein the first virtualization algorithm accounts for:

a speaker configuration of the rear sound bar, an intended location of the rear sound bar being behind a listener, and an intended distance of the listener from the rear sound bar.

10. The audio processing unit of claim 9, wherein the intended location of the rear sound bar includes being adjacent to a rear wall, and wherein the intended distance of the listener from the rear sound bar is within a pre-determined distance.

11. The audio processing unit of claim 9, wherein the processing, by the rear virtualizer component, the first set of rear audio signals to create a second set of rear audio signals suitable for playback on a rear sound bar includes:

processing, by a rear height virtualizer, a subset of the received first set of rear audio signals;

not processing, by the rear height virtualizer, the remainder of the received first set of rear audio signals;

and then, using the first virtualization algorithm:

decorrolating the processed subset and the remainder of the received first set of rear audio signals to create a decorrolated set of rear audio signals based on a number of channels in the rear sound bar, gain-adjusting the decorrolated set of rear audio signals to create a gain-adjusted set of rear audio signals, and cross-mixing the gain-adjusted set of rear audio signals to create the second set of rear audio signals.

12. The audio processing unit of claim 8, further including the rear sound bar and the method further comprising:

providing, by the audio processing unit, the second set of rear audio signals to the rear sound bar.

13. The audio processing unit of claim 8, wherein the method further comprises creating a first set of front audio signals for a front set of speakers.

14. The audio processing unit of claim 13, wherein the front set of speakers includes a front sound bar, wherein the first set of front audio signals are front audio signals suitable for playback on the front sound bar, and wherein the method further comprises:

processing, by a front virtualizer component, an initial set of front audio signals to create the first set of front audio signals, the processing using a second panning algorithm that accounts for:

a speaker configuration of the front sound bar, and an intended distance of the listener from the front sound bar.

15. The method of claim 8, wherein the first virtualization algorithm uses at least one of: cross talk cancellation, binauralization, and diffuse panning.

16. A system for a providing an immersive listening area, comprising:

a decoder configured to provide a front set and a rear set of signals;

a front plurality of speakers configured to provide a front sound stage upon receiving the front set of signals;

a rear virtualizer configured to receive the rear set of signals and to create a set of virtualized rear signals using a first virtualization algorithm, the creating including the steps of:

decorrolating the received first set of rear audio signals to create a decorrolated set of rear audio signals based on a number of channels in the rear sound bar;

gain-adjusting the decorrolated set of rear audio signals to create a gain-adjusted set of rear audio signals, and cross-mixing the gain-adjusted set of rear audio signals to create the second set of rear audio signals; and a rear sound bar configured to receive the set of virtualized rear signals and provide a rear sound stage upon playback of the virtualized rear signals.

17. The system of claim 16, wherein the first virtualization algorithm accounts for:

a speaker configuration of the rear sound bar, an intended location of the rear sound bar being behind a listener, and an intended distance of the listener from the rear sound bar.

18. The system of claim 17, wherein the intended location of the rear sound bar includes being adjacent to a rear wall, and wherein the intended distance of the listener from the rear sound bar is within a pre-determined distance.

19. The system of claim 17, wherein the rear virtualizer includes a height virtualizer, a decorrolator, and a gain-adjusted cross-mixer, and wherein the height virtualizer is configured to receive the rear height signals and provide a set of virtualized height signals to the decorrolator, the decorrolator is configured to receive the rear surround signals and the virtualized height signals and provide a decorrolated set of signals to the gain-adjusted cross-mixer, and the gain-adjusted cross-mixer is configured to provide the set of virtualized rear signals to the rear sound bar.

20. The system of claim 17, wherein the rear virtualizer includes a first decorrolator, a second decorrolator, and a gain-adjusted cross-mixer, and wherein the first decorrolator is configured to receive a first rear signal and provide a first decorrolated set of signals to the gain-adjusted cross-mixer, the second decorrolator is configured to receive a second rear signal and provide a second set of decorrolated signals to the gain-adjusted cross-mixer, and the gain-adjusted cross-mixer is configured to provide the third set of signals using the first and second sets of decorrolated signals.

21. The method of claim 16, wherein, to provide a virtualized set of rear signals, the rear virtualizer uses at least one of: cross talk cancellation, binauralization, and diffuse panning.

* * * * *